US009254700B2

(12) United States Patent
Otokita et al.

(10) Patent No.: US 9,254,700 B2
(45) Date of Patent: Feb. 9, 2016

(54) LIQUID DISCHARGE DEVICE, AND DISCHARGE ABNORMALITY TESTING METHOD

(71) Applicant: SEIKO EPSON CORPORATION, Tokyo (JP)

(72) Inventors: Kenji Otokita, Yamagata-mura (JP); Shinya Komatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/614,835

(22) Filed: Feb. 5, 2015

(65) Prior Publication Data

US 2015/0231907 A1 Aug. 20, 2015

(30) Foreign Application Priority Data

Feb. 14, 2014 (JP) ..... 2014-026319

(51) Int. Cl.
*B41J 29/393* (2006.01)

(52) U.S. Cl.
CPC ..... *B41J 29/393* (2013.01)

(58) Field of Classification Search
CPC .. B41J 2/2142; B41J 2029/3935; B41J 2/125; B41J 2/0451; B41J 11/0095; B41J 2/16579; B41J 2/175; B41J 2/01
See application file for complete search history.

(56) References Cited

U.S. PATENT DOCUMENTS 6,257,694 B1 * 7/2001 Tokumaru ..... B41J 2/19 347/19
6,375,299 B1 * 4/2002 Foster ..... B41J 2/0451 347/19
7,300,131 B2 11/2007 Sakagami et al.

FOREIGN PATENT DOCUMENTS

JP 3867787 B2 1/2007
JP 2007-030343 A 2/2007
JP 3933186 B2 6/2007

* cited by examiner

*Primary Examiner* — Lamson Nguyen
(74) *Attorney, Agent, or Firm* — Global IP Counselors, LLP

(57) ABSTRACT

A liquid discharge device includes a head having a piezoelectric element that vibrates a vibrating plate, a pressure chamber for which the internal pressure is increased and decreased by vibration of the vibrating plate, and a nozzle in communication with the pressure chamber, that can discharge a liquid by increasing and decreasing the pressure of the pressure chamber, a drive unit that outputs drive signals to the piezoelectric element, a testing unit that tests discharge abnormality of the nozzle based on a vibration pattern of residual vibration inside the pressure chamber that occurs due to the drive signals, and a control unit that has the drive unit output a second drive signal after having it output a first drive signal, and that has the testing unit detect the discharge abnormality of the nozzle after the second drive signal is output.

7 Claims, 16 Drawing Sheets

LIQUID DISCHARGE DEVICE, AND DISCHARGE ABNORMALITY TESTING METHOD

CROSS-REFERENCE TO RELATED APPLICATIONS

This application claims priority to Japanese Patent Application No. 2014-026319 filed on Feb. 14, 2014. The entire disclosure of Japanese Patent Application No. 2014-026319 is hereby incorporated herein by reference.

BACKGROUND

1. Technical Field

The present invention relates to a liquid discharge device, and a discharge abnormality testing method.

2. Related Art

From the past, inkjet printers as liquid discharge devices for which liquid (ink) is discharged as droplets from nozzles of a head (inkjet head) using the inkjet method to perform image formation on media have become widely popular since it is easy to obtain a high quality printed object at a relatively low cost. The inkjet printer head has a piezoelectric element for vibrating a vibrating plate, a pressure chamber for which liquid is stored in the interior, for increasing and decreasing the internal pressure using vibration of the vibration plate, and a plurality of nozzles provided in communication with the pressure chamber on the head nozzle surface, and liquid is discharged from the nozzles by the piezoelectric element being driven by drive signals to increase and decrease the pressure of the pressure chamber.

In recent years, there has been even further increase in demand for the quality of formed images, and along with that, an even larger number of nozzles are being provided on the nozzle surface of the inkjet printer head. With this kind of head, due to reasons such as an increase in ink viscosity, mixing in of air bubbles, adhesion of dust, paper powder or the like, there are cases when among the large number of nozzles, several nozzles become clogged, and it is not possible to discharge ink droplets. When nozzles become clogged, missing dots occur within the printed image, which is a cause of image quality degradation.

As a method of detecting liquid discharge abnormalities to prevent image quality degradation of images such as of missing dots or the like, for example in Japanese Unexamined Patent Publication No. 2007-30343, introduced is a method whereby drive signals are output to a piezoelectric element, the residual vibration after changes in pressure within the pressure chamber due to those drive signals are detected as changes in the electromotive force of the piezoelectric element, and based on the vibration pattern of that residual vibration, abnormalities are detected in the discharge of ink from the nozzle. Using this discharge abnormality detection method, the presence or absence of discharge abnormalities is confirmed, and when a discharge abnormality is detected, by performing maintenance processing such as nozzle surface sweeping, cleaning or the like, it is possible to prevent image quality degradation.

SUMMARY

However, with the discharge abnormality detection method noted in Japanese Unexamined Patent Publication No. 2007-30343, when there is not a certain level of difference in the waveform pattern (vibration pattern) such as the amplitude, phase, cycle and the like of the residual vibration compared to when it is in a normal state, it is difficult to detect as a discharge abnormality. For example, when very fine foreign matter adheres to the nozzle surface of the head after head cleaning and remains, it was difficult to detect that as foreign matter because it almost didn't appear as a change in the residual vibration waveform. Because of this, even when discharge abnormality detection of the head was performed, it was not possible to detect foreign matter adhered to the nozzle surface, and there was the problem of concern about causing a discharge abnormality of the liquid (droplets) during printing.

The present invention was created to address at least a portion of the problems described above, and can be realized as the following modes or aspects.

A liquid discharge device according to one aspect includes a head, a drive unit, a testing unit and a control unit. The head has a piezoelectric element configured and arranged to vibrate a vibrating plate, a pressure chamber configured and arranged to increase and decrease an internal pressure by vibrating the vibrating plate, and a nozzle in communication with the pressure chamber, configured and arranged to discharge liquid housed in the pressure chamber by increasing and decreasing the internal pressure of the pressure chamber. The drive unit is configured and arranged to output drive signals to the piezoelectric element. The testing unit is configured and arranged to test for discharge abnormality of the nozzle based on a vibration pattern of residual vibration within the pressure chamber that occurred due to the drive signals. The control unit is configured to control the drive unit to output a second drive signal after a first drive signal is output, and to control the testing unit to test the discharge abnormality of the nozzle after the second drive signal is output by the drive unit.

With this aspect, by performing testing of discharge abnormalities of the nozzles after the first drive signal and the second drive signal are output, it is possible to test for nozzle discharge abnormalities in a state with the difference broadened between the vibration pattern of normal nozzle residual vibration and the vibration pattern of abnormal nozzle residual vibration.

With the liquid discharge device of the aspect noted above, the first drive signal is preferably a drive signal for exhausting the liquid from the nozzle.

With this aspect, it is possible to have the liquid in a state existing between the nozzle and foreign matter adhered to the nozzle for nozzles to which foreign matter has adhered.

With the liquid discharge device of the aspects noted above, the second drive signal preferably has a waveform that is different from a waveform of the first drive signal, and the second drive signal is preferably a resonance waveform drive signal that resonates with natural vibration of the pressure chamber.

With this aspect, it is possible to further broaden the difference between the vibration pattern of normal nozzle residual vibration and the vibration pattern of abnormal nozzle residual vibration.

With the liquid discharge device of the aspects noted above, the first drive signal preferably has a waveform that is the same as a waveform of the second drive signal, and the first drive signal and the second drive signal are preferably resonance waveform drive signals that resonate with natural vibration of the pressure chamber.

With this aspect, it is possible to further broaden the difference between the vibration pattern of normal nozzle residual vibration and the vibration pattern of abnormal nozzle residual vibration.

With the liquid discharge device of the aspects noted above, the resonance waveform preferably has N times of vibration, with N being an integer of 2 or greater.

With this aspect, it is possible to make it easier to break the meniscus of the liquid on nozzles to which foreign matter has adhered, and to further broaden the difference between the vibration pattern of normal nozzle residual vibration and the vibration pattern of abnormal nozzle residual vibration.

With the liquid discharge device of the aspects noted above, with the resonance waveform, an amplitude of an Nth vibration is preferably greater than an amplitude of a first vibration.

With this aspect, it is possible to prevent a large break all at once of the meniscus of the liquid at nozzles to which foreign matter has adhered.

A discharge abnormality testing method according to another aspect is a testing method for a head having a piezoelectric element configured and arranged to vibrate a vibrating plate, a pressure chamber configured and arranged to increase and decrease an internal pressure by vibrating the vibrating plate, and a nozzle in communication with the pressure chamber and configured and arranged to discharge liquid housed in the pressure chamber by increasing and decreasing the internal pressure of the pressure chamber. The discharge abnormality testing method includes: outputting a second drive signal to the piezoelectric element after a first drive signal is output; and testing discharge abnormality of the nozzle based on a vibration pattern of residual vibration within the pressure chamber that occurred due to the second drive signal.

With this aspect, by performing testing of nozzle discharge abnormalities after the first drive signal and the second drive signal are output, it is possible to test for nozzle discharge abnormalities in a state with the difference broadened between the vibration pattern of normal nozzle residual vibration and the vibration pattern of abnormal nozzle residual vibration.

A liquid discharge device according to another aspect includes a head, a drive unit, a testing unit and a control unit. The head has a piezoelectric element configured and arranged to vibrate a vibrating plate, a pressure chamber configured and arranged to increase and decrease an internal pressure by vibrating the vibrating plate, and a nozzle in communication with the pressure chamber, configured and arranged to discharge liquid housed in the pressure chamber by increasing and decreasing the internal pressure of the pressure chamber. The drive unit is configured and arranged to output drive signals to the piezoelectric element. The testing unit is configured and arranged to test for discharge abnormality of the nozzle based on a vibration pattern of residual vibration within the pressure chamber that occurred due to the drive signals. The control unit is configured to control the testing unit to test for the discharge abnormality of the nozzle after having air bubbles trapped in at least one of the liquid inside the nozzle which is a foreign matter adhesion nozzle to which foreign matter, which can cause the discharge abnormality, has adhered, and the liquid inside the pressure chamber in communication with the foreign matter adhesion nozzle.

With this aspect, the vibration pattern of the residual vibration of foreign matter adhesion nozzle changes. Because of this, it is possible to test for nozzle discharge abnormalities in a state with the difference broadened between the vibration pattern of normal nozzle residual vibration and the vibration pattern of abnormal nozzle residual vibration.

A liquid discharge device according to another aspect includes a head, a drive unit, a testing unit and a control unit. The head has a piezoelectric element configured and arranged to vibrate a vibrating plate, a pressure chamber configured and arranged to increase and decrease an internal pressure by vibrating the vibrating plate, and a nozzle in communication with the pressure chamber, configured and arranged to discharge liquid housed in the pressure chamber by increasing and decreasing the internal pressure of the pressure chamber. The drive unit is configured and arranged to output drive signals to the piezoelectric element. The testing unit is configured and arranged to test for discharge abnormality of the nozzle based on a vibration pattern of residual vibration within the pressure chamber that occurred due to the drive signals. The control unit is configured to control the testing unit to test for the discharge abnormality of the nozzle after breaking meniscus of the liquid in the nozzle which is a foreign matter adhesion nozzle to which foreign matter, which can cause the discharge abnormality, has adhered.

With this aspect, the vibration pattern of the residual vibration of the foreign matter adhesion nozzle changes. Because of this, it is possible to test for nozzle discharge abnormalities in a state with the difference broadened between the vibration pattern of normal nozzle residual vibration and the vibration pattern of abnormal nozzle residual vibration.

BRIEF DESCRIPTION OF THE DRAWINGS

Referring now to the attached drawings which form a part of this original disclosure:

FIG. 4 is applied.

DETAILED DESCRIPTION OF EXEMPLARY EMBODIMENTS

Following, we will describe a specific embodiment of the present invention based on the drawings. With each of the drawings below, to make each member or the like a size of a recognizable level, the scale of each member and the like is shown as different from the actuality.

Inkjet Printer

Figure 1:
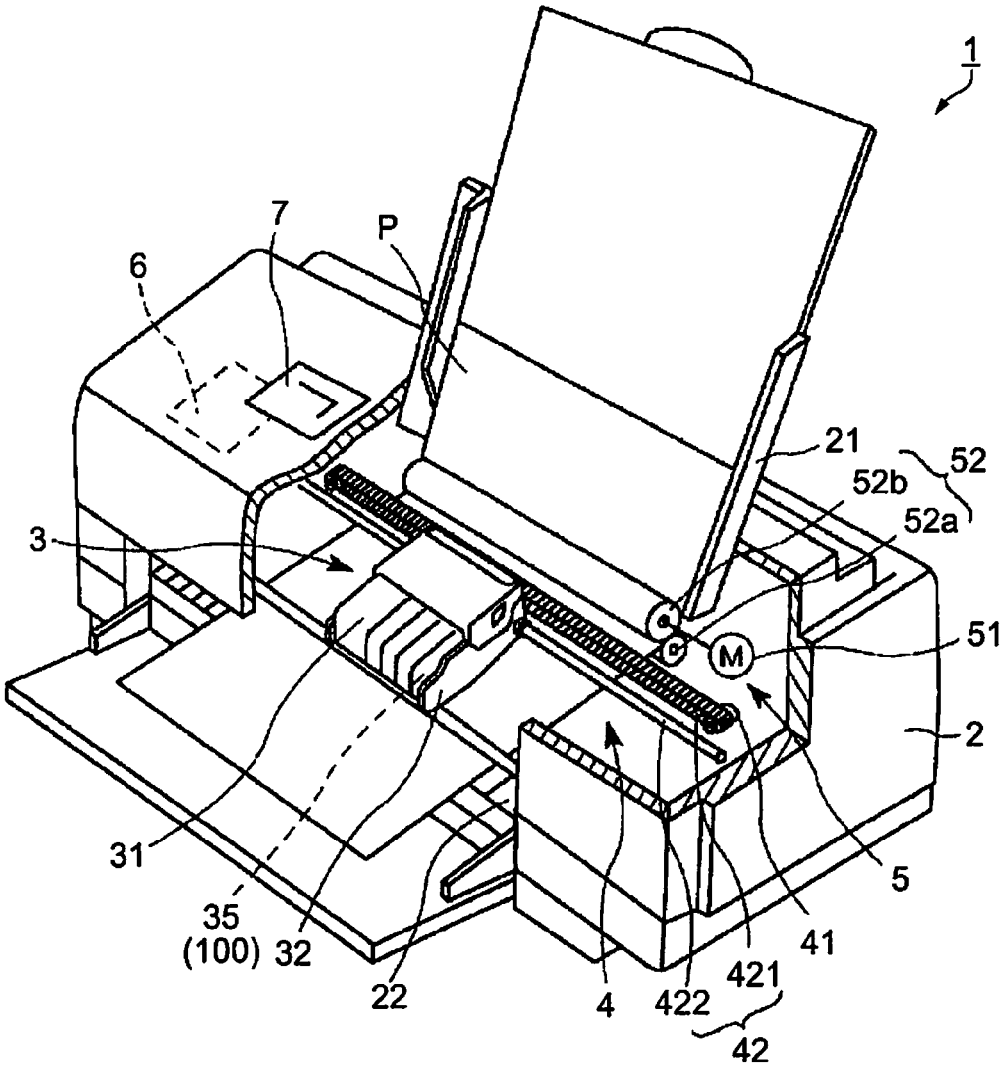
FIG. 1 is a perspective view showing the schematic structure of an inkjet printer as the liquid discharge device of the embodiment.

First, we will describe an inkjet printer 1 as the liquid discharge device of this embodiment. FIG. 1 is a perspective view showing the schematic structure of the inkjet printer 1. With the description below, in FIG. 1, the upper side is called the "top part," and the lower side is called the "bottom part."

The inkjet printer 1 shown in FIG. 1 is equipped with a device main unit (case) 2, and on that device main unit 2, provided are a tray 21 at the top part rear in which recording media P is arranged, a paper ejection port 22 at the bottom part front for ejecting recording media P, and an operating panel 7 at the top part surface. The inkjet printer 1 can discharge ink as an example of a liquid.

The operating panel 7 is constituted using a liquid crystal display, an organic EL display, an LED lamp or the like, for example, and it is equipped with a display unit (not illustrated) for displaying error messages or the like, and an operating unit (not illustrated) constituted using various switches or the like. This display unit of the operating panel 7 functions as a notification unit to give notification of printing status and errors.

Also, in the interior of the device main unit 2, there is mainly a printing device 4 equipped with a printing unit (moving body) 3 that does back and forth movement, a paper feed device (droplet receiving object conveyance unit) 5 that supplies and ejects recording media P in relation to the printing device 4, and a control unit 6 for controlling the printing device 4 and the paper feed device 5.

By the control of the control unit 6, the paper feed device 5 intermittently feeds the recording media P one sheet at a time. This recording media P passes through the bottom part vicinity of the printing unit 3. At this time, the printing unit 3 moves back and forth in the direction almost orthogonal to the feed direction of the recording media P, and printing is performed on the recording media P. Specifically, back and forth movement of the printing unit 3 and intermittent feeding of the recording media P are the main scan and the sub scan with printing, and inkjet method printing is performed.

The printing device 4 is equipped with a printing unit 3, a carriage motor 41 that is the drive source that moves the printing unit 3 in the main scan direction (back and forth movement), and a back and forth movement mechanism 42 that undergoes rotation by the carriage motor 41 and moves the printing unit 3 back and forth.

The printing unit 3 has a plurality of head units 35, an ink cartridge (I/C) 31 for supplying ink to each head unit 35, and a carriage 32 in which each head unit 35 and ink cartridge 31 is placed. In the case of an inkjet printer with a large ink consumption volume, for example, it is possible to be constituted such that the ink cartridge 31 is not placed in the carriage 32 and is installed in a different location, and ink is supplied via a tube (not illustrated) provided with the ink cartridge 31 and the head unit 35 in communication.

As the ink cartridges 31, by using items in which four colors of ink are housed including yellow, cyan, magenta, and black, for example, full color printing is possible. In this case, head units 35 (this constitution is described in detail later) corresponding to each respective color are provided in the printing unit 3. Here, with FIG. 1, four ink cartridges 31 corresponding to the four colors of ink are shown, but the printing unit 3 can also be constituted so as to be further equipped with ink cartridges 31 of special inks or the like such as other colors including light cyan, light magenta, or dark yellow, for example.

The back and forth movement mechanism 42 has a carriage guide shaft 422 for which both ends are supported on a frame (not illustrated), and a timing belt 421 provided extending in parallel to the carriage guide shaft 422.

The carriage 32 is supported so as to freely move back and forth on the carriage guide shaft 422 of the back and forth movement mechanism 42, and is fixed to a portion of the timing belt 421.

By the operation of the carriage motor 41, when the timing belt 421 is run forward and reverse via a pulley, it is guided on the carriage guide shaft 422, and the printing unit 3 moves back and forth. Then, when doing this back and forth movement, ink droplets are discharged as appropriate from each inkjet head 100 (see FIG. 3) of the head unit 35 based on the printed image data (print data), and printing is performed on the recording media P.

The paper feed device 5 has a paper feed motor 51 which is its drive source, and a paper feed roller 52 that is rotated by operation of the paper feed motor 51.

The paper feed roller 52 is constituted by a driven roller 52*a* and a drive roller 52*b* facing opposite vertically sandwiching the conveyance path of the recording media P (recording media P), and it is possible to sandwich the recording media P. Also, the drive roller 52*b* is linked to the paper feed motor 51. By doing this, the paper feed roller 52 sends one sheet at a time of the many sheets of recording media P arranged in the tray 21 toward the printing device 4, and is able to eject one sheet at a time from the printing device 4. Instead of the tray 21, it is also possible to constitute this with a freely detachable paper feed cassette in which recording media P is housed.

Furthermore, the paper feed motor 51 moves jointly with the back and forth movement action of the printing unit 3, and performs paper feeding of the recording media P according to the image resolution. For the paper feeding operation and the paper sending operation, it is possible to perform them with respectively different motors, and also possible to perform them with the same motor using a part that performs switching of the torque transmission such as an electromagnetic clutch or the like.

The control unit 6 performs printing processing on the recording media P by controlling the printing device 4 and the paper feed device 5 and the like based on print data input from a host computer 8 (see FIG. 2) such as a personal computer (PC), a digital camera (DC) or the like. Also, the control unit 6 displays an error message or the like on the display unit of the operating panel 7, or lights/blinks an LED lamp or the like, and based on a pressing signal for each type of switch input from the operating unit, has each part execute its corresponding process. Furthermore, the control unit 6 transmits information such as an error message, discharge abnormality or the like to the host computer 8 as necessary.

Figure 2:
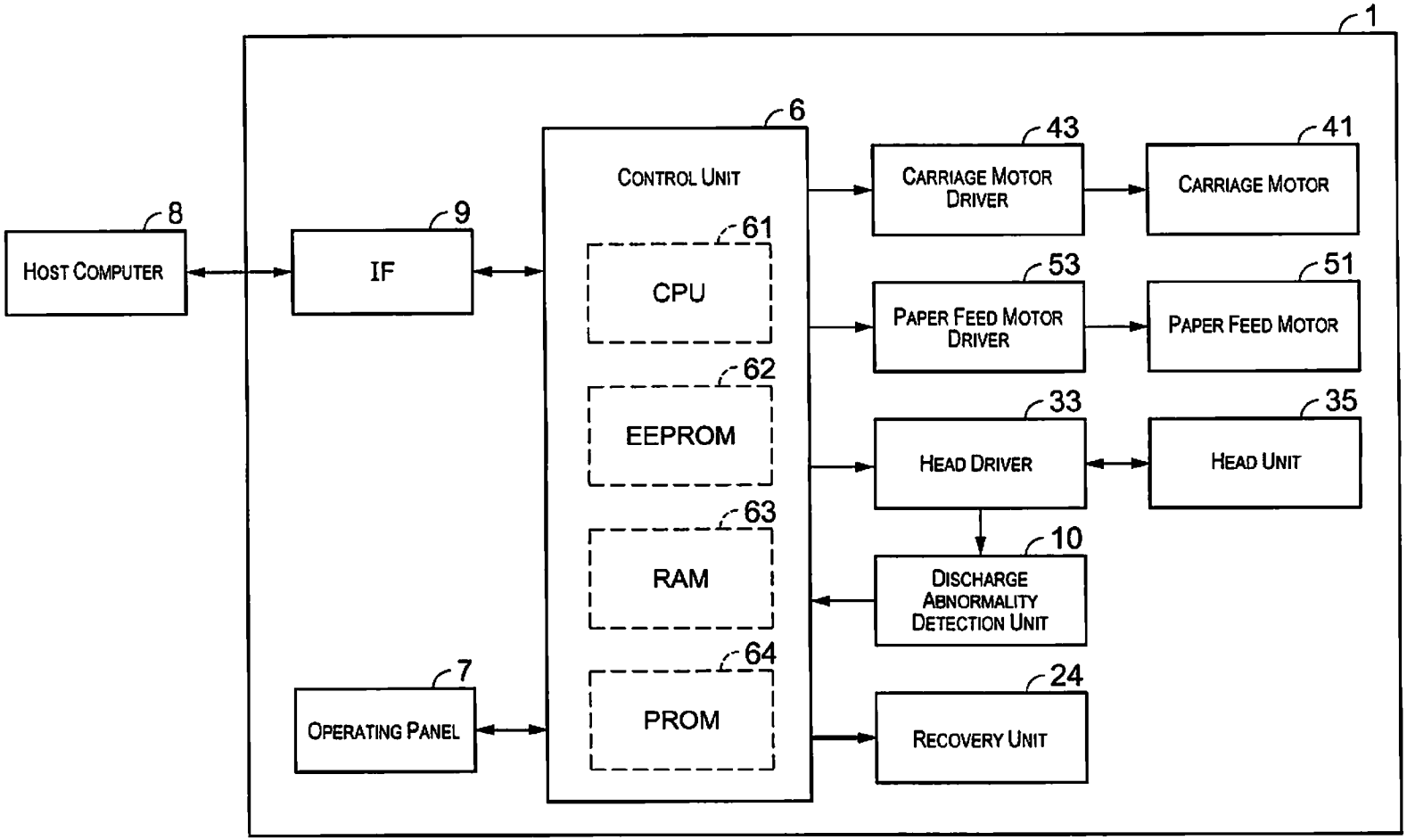
FIG. 2 is a block diagram schematically showing the key parts of the inkjet printer of the embodiment.

FIG. 2 is a block diagram that schematically shows the key parts of the inkjet printer 1 of this embodiment.

In FIG. 2, the inkjet printer 1 is equipped with an interface unit IF 9 that receives print data and the like input from the host computer 8, the control unit 6, the carriage motor 41, a carriage motor driver 43 that does drive control of the carriage motor 41, the paper feed motor 51, a paper feed motor driver 53 that does drive control of the paper feed motor 51, the head unit 35, a head driver 33 that does drive control of the head unit 35, the discharge abnormality detection unit 10, a recovery unit 24, and the operating panel 7. The abnormality detection unit 10, the recovery unit 24, and the head driver 33 will be described in detail later.

In this FIG. 2, the control unit 6 is equipped with a CPU (Central Processing Unit) 61 for executing various processes such as the printing process, discharge abnormality detection process or the like, an EEPROM (Electrically Erasable Programmable Read Only Memory) (storage unit) 62 which is one type of nonvolatile semiconductor memory which stores in a data storage area (not illustrated) print data input via IF 9 from the host computer 8, a RAM (Random Access Memory) 63 that temporarily stores various types of data when executing the discharge abnormality detection process or the like described later or temporarily expands application programs such as for print processing and the like, and a PROM 64 which is one type of nonvolatile memory for storing control programs that control each part or the like. Each constitutional element of the control unit 6 is electrically connected via a bus (not illustrated).

As described above, the printing unit 3 is equipped with a plurality of head units 35 corresponding to each color of ink. Also, each head unit 35 is equipped with a plurality of nozzles 110, and an electrostatic actuator 120 constituted by piezoelectric elements respectively corresponding to each of these nozzles 110 (see FIG. 3). Specifically, the head unit 35 is constituted equipped with a plurality of the inkjet heads 100 (see FIG. 3) as the head having one set of the nozzle 110 and the electrostatic actuator 120.

When the control unit 6 obtains print data from the host computer 8 via the IF 9, it stores that print data in the EEPROM 62. Then, the CPU 61 executes a designated process on this print data, and outputs drive signals to each driver 33, 43, and 53 based on this process data and the input data from the various sensors. When these drive signals are input via each driver 33, 43, and 53, the plurality of electrostatic actuators 120 of the head unit 35, the carriage motor 41 and the paper feed device 5 of the printing device 4 are respectively operated. By doing this, printing processing is executed on the recording media P.

Though not illustrated, various types of sensors that can detect, for example, the ink residual volume of the ink cartridge 31, and the printing environment such as the position, temperature, humidity and the like of the printing unit 3 are respectively electrically connected to the control unit 6.

Head Unit

Figure 3:
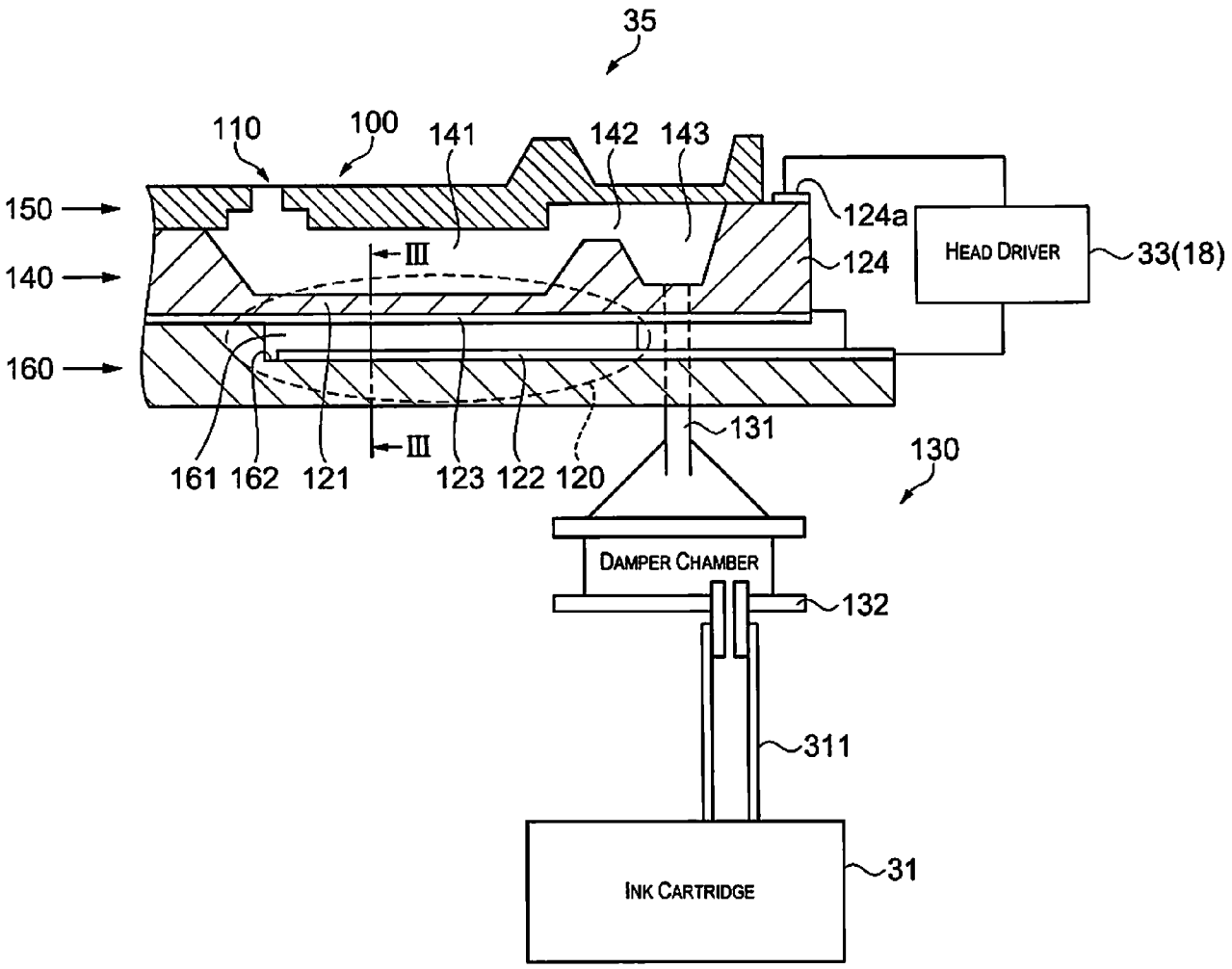
FIG. 3 is a schematic cross section view of the head unit (inkjet head).
Figure 4:
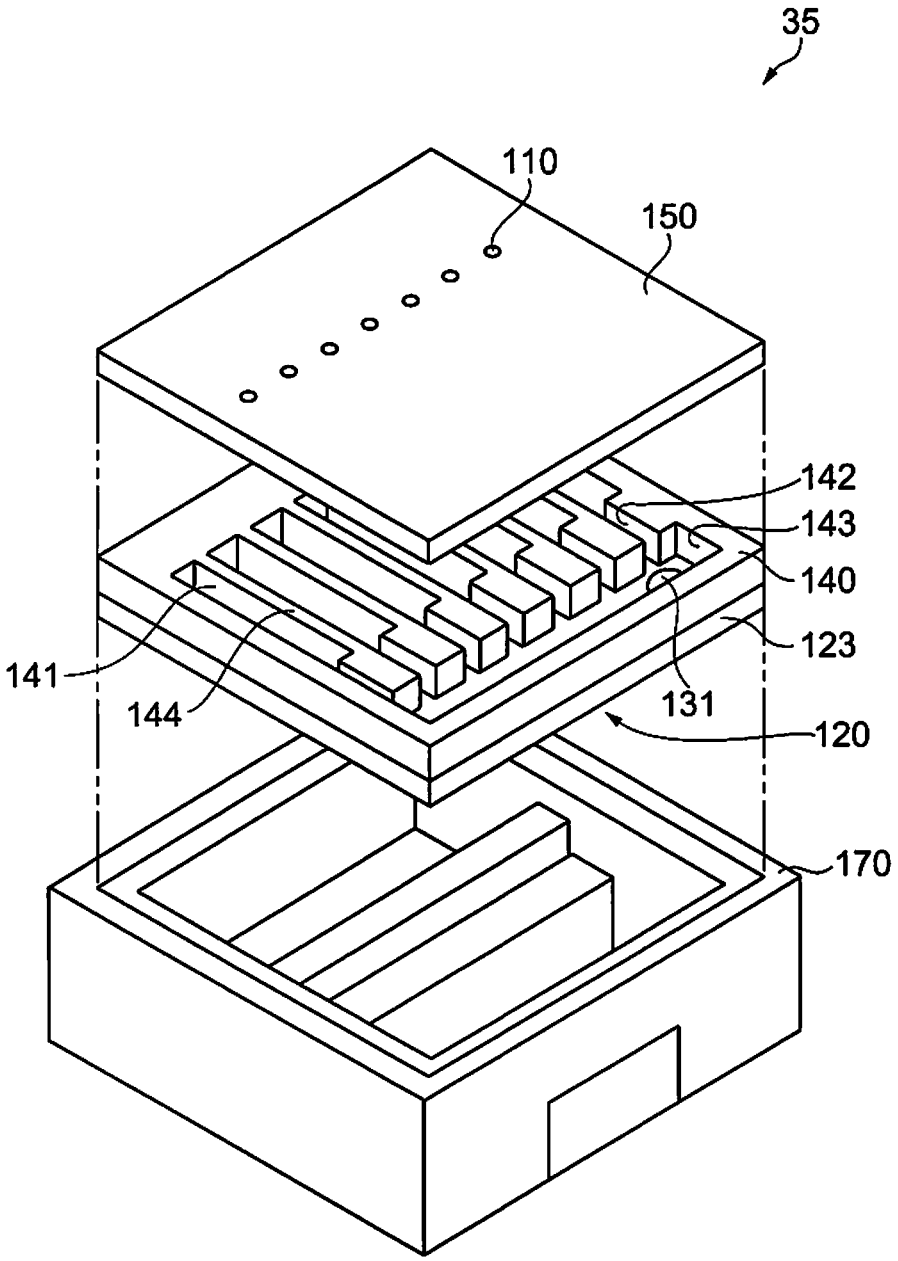
FIG. 4 is an exploded perspective view showing the schematic structure of the head unit corresponding to one color of ink.
Figure 5:
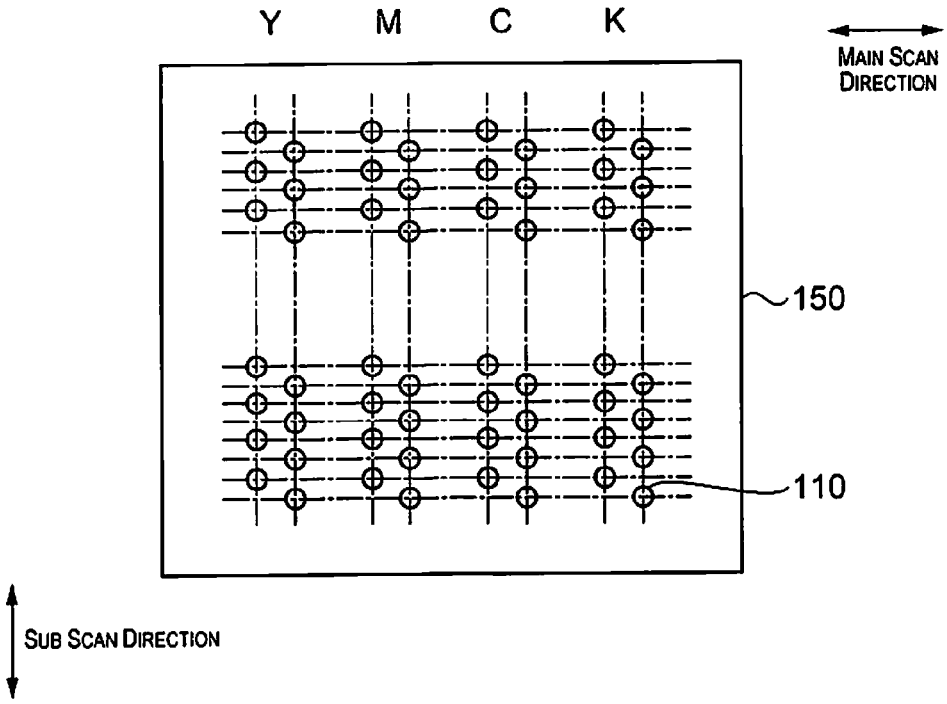
FIG. 5 is a plan view showing an example of the nozzle surface of a printing unit to which the head unit shown in FIG. 3

Next, we will describe in detail the structure of each head unit 35 within the printing unit 3 while referring to the drawings. FIG. 3 is a schematic cross section view of the head unit 35 (inkjet head 100) shown in FIG. 1, FIG. 4 is an exploded perspective view showing the schematic structure of the head unit 35 corresponding to one ink color, and FIG. 5 is a plan view showing an example of the nozzle surface of the printing unit 3 for which the head unit 35 shown in FIG. 3 and FIG. 4 is applied. FIG. 3 and FIG. 4 show the normally used state vertically inverted.

As shown in FIG. 3, the head unit 35 is connected to the ink cartridge 31 via an ink intake port 131, a damper chamber 130, and an ink supply tube 311. Here, the damper chamber 130 is equipped with a damper 132 constituted from rubber. Using this damper chamber 130, it is possible to absorb shaking of the ink and changes in the ink pressure when the carriage 32 is run back and forth, and by doing this, it is possible to stably supply a designated volume of ink to the head unit 35.

Also, the head unit 35 has a three layer structure for which respectively laminated are a nozzle plate 150 similarly made of silicon sandwiching a silicon substrate 140 on one side (the top side in the drawing), and a borosilicate glass substrate (glass substrate) 160 with a coefficient of thermal expansion close to that of silicon on the other side (lower side in the drawing). On the center silicon substrate 140, grooves are formed that respectively function as a plurality of independent cavities (pressure chambers) 141 (in FIG. 4, seven cavities are shown), one reservoir (common ink chamber) 143 and an ink supply port (orifice) 142 that puts this reservoir 143 in communication with each cavity 141. Each groove can be formed by implementing etching processing from the surface of the silicon substrate 140, for example. This nozzle plate 150, the silicon substrate 140, and the glass substrate 160 are joined in this sequence, and each cavity 141, the reservoir 143, and each ink supply port 142 are formed partitioned.

These cavities 141 are respectively formed in rectangular solid form, their capacity is variable by vibration (displacement) of a vibrating plate 121 described later, and the constitution is such that ink (liquid) is discharged from the nozzles 110 due to this capacity change. The nozzles 110 are formed on the nozzle plate 150 at positions corresponding to the part of the tip side of each cavity 141, and these nozzles 110 are in communication with each cavity 141. Also, at the part of the glass substrate 160 at which the reservoir 143 is positioned, an ink intake port 131 in communication with the reservoir 143 is formed. The ink is supplied from the ink cartridge 31 to the ink supply tube 311, via the damper chamber 130 to the ink intake port 131, and through that to the reservoir 143. The ink supplied to the reservoir 143 passes through each ink supply port 142, and is supplied independently to each cavity 141. Each cavity 141 is formed partitioned by the nozzle plate 150, a side wall (partition wall) 144, and a bottom wall 121.

Each independent cavity 141 has the bottom wall 121 formed to be thin, and the bottom wall 121 is constituted to function as a vibrating plate (diaphragm) capable of elastic deformation (elastic displacement) in the surface outward direction (thickness direction), specifically, in the vertical direction in FIG. 3. Therefore, this bottom wall 121 part, for purposes of explanation hereafter, may also be described with the name vibrating plate 121 (specifically, hereafter code number 121 is used for both "bottom wall" and "vibrating plate").

On the surface of the silicon substrate 140 side of the glass substrate 160, at positions corresponding to each cavity 141 of the silicon substrate 140, shallow recess parts 161 are respectively formed. Therefore, the bottom wall 121 of each cavity 141 confronts the surface of the opposite facing wall 162 of the glass substrate 160 on which the recess part 161 is formed via a designated interval. Specifically, a gap of a designated thickness (e.g. about 0.2 microns) exists between the bottom wall 121 of the cavity 141 and a segment electrode 122 described later. The recess part 161 can be formed by etching or the like, for example.

Here, the bottom wall (vibrating plate) 121 of each cavity 141 constitutes a portion of a common electrode 124 of each cavity 141 side for storing the respective charges by drive signals supplied from the head driver 33. Specifically, the vibrating plate 121 of each cavity 141 respectively serves as one of the counter electrodes (counter electrodes of the capacitor) of a corresponding electrostatic actuator 120 described later. Then, so as to confront the bottom wall 1221 of each cavity 141 on the surface of the recess part 161 of the glass substrate 160, segment electrodes 122 which are electrodes facing opposite the common electrode 124 are respectively formed. Also, as shown in FIG. 3, the surface of the bottom wall 121 of each cavity 141 is covered by an insulating layer 123 consisting of a silicon oxide film ($SiO_2$). In this way, the bottom wall 121 of each cavity 141, specifically, the vibrating plate 121 and each segment electrode 122 corresponding to those form (constitute) counter electrodes (counter electrodes of the capacitor) via the gap between the insulating layer 123 formed on the surface of the bottom side in FIG. 3 of the bottom wall 121 of the cavity 141 and the inside of the recess part 161. Therefore, the key parts of the electrostatic actuator 120 are constituted by the vibrating plate 121, the segment electrode 122, and the insulating layer 123 and the gap between these.

As shown in FIG. 3, the head driver 33 including the driver circuit 18 for applying a drive voltage between these counter electrodes performs charging and discharging between these counter electrodes according to the printing signals (printing data) input from the control unit 6. One of the output terminals of the head driver (voltage application part) 33 is connected to each individual segment electrode 122, and the other output terminal is connected to an input terminal 124*a* of the common electrode 124 formed on the silicon substrate 140. Impurities are implanted in the silicon substrate 140, and since that item itself is conductive, it is possible to supply voltage to the common electrode 124 of the bottom wall 121 from the input terminal 124*a* of this common electrode 124. Also, for example it is also possible to form a thin film of a conductive material such as gold, copper or the like on one surface of the silicon substrate 140. By doing this, it is possible to (efficiently) supply voltage (charge) to the common electrode 124 with low electrical resistance. This thin film can be formed using vapor deposition, sputtering or the like, for example. Here, with this embodiment, for example, the silicon substrate 140 and the glass substrate 160 are joined (coupled) by an anode junction, so a conductive film is formed on the flow path forming surface side of the silicon substrate 140 (top part side of the silicon substrate 140 shown in FIG. 3) using that anode junction as the electrode. Then, this conductive film is used as is as the input terminal 124*a* of the common electrode 124. With the present invention, for example it is also possible to omit the input terminal 124*a* of the common electrode 124, and the joining method of the silicon substrate 140 and the glass substrate 160 is not limited to being an anode junction.

Head Unit, Nozzle Arrangement Pattern

As shown in FIG. 4, the head unit 35 is equipped with a nozzle plate 150 on which the plurality of nozzles 110 are formed, a silicon substrate (ink chamber substrate) 140 on which a plurality of cavities 141, a plurality of ink supply ports 142, and one reservoir 143 are formed, and an insulating layer 123, and these are housed in a base 170 including the glass substrate 160. The base 170 is constituted with various types of resin material, various types of metal material or the like, for example, and the silicon substrate 140 is fixed and supported on this base 170.

The nozzles 110 formed on the nozzle plate 150 are arranged linearly roughly parallel to the reservoir 143 to show this simply in FIG. 4, but the nozzle arrangement pattern is not limited to this constitution, and normally, for example, as with the nozzle arrangement pattern shown in FIG. 5, they are arranged with the levels skewed. Also, the pitch between these nozzles 110 can be suitably set according to the printing resolution (dpi: dots per inch). With FIG. 5, the arrangement of the nozzles 110 is shown when four colors of ink (ink cartridges 31) are used. Here, to summarize the inkjet head (head) 100, the head 100 has the piezoelectric element that vibrates the vibrating plate 121, the pressure chamber 141 that increases and decreases the internal pressure using the vibration of the vibrating plate 121, and nozzles 110 in communication with the pressure chamber 141, for discharging liquid housed in the pressure chamber 141 by increasing and decreasing the pressure of the pressure chamber 141.

Residual Vibration of the Head Unit

Figure 6A:
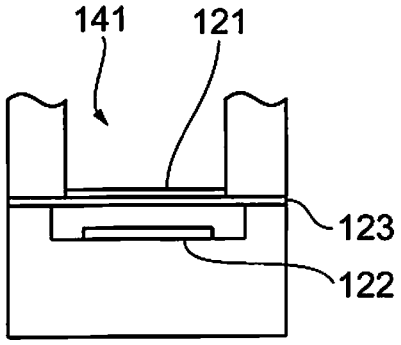
FIGS. 6A to 6C are explanatory drawings showing each state during drive signal input to the III-III cross section of FIG. 3.
Figure 6B:
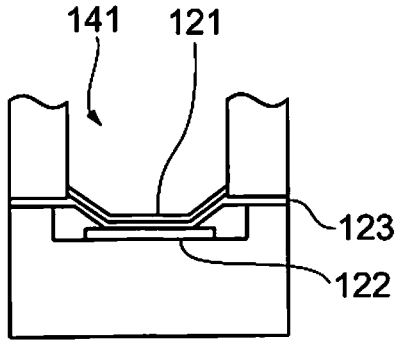
Figure 6C:
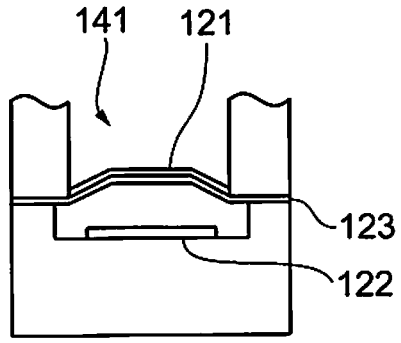

FIGS. 6A to 6C show each state during drive signal input of the cross section of the head unit 35 in FIG. 3.

When drive voltage is applied between counter electrodes from the head driver 33, Coulomb force is generated between the counter electrodes, and the bottom wall (vibrating plate) 121 enlarges the capacity of the cavity 141 by bending to the segment electrode 122 side (FIG. 6B) compared to the initial state (FIG. 6A). In this state, by control of the head driver 33, when the charge between the counter electrodes is rapidly discharged, the vibrating plate 121 is restored upward in the drawing by the elastic restoration force, it is moved to the top part past the position of the vibration plate 121 in the initial state, and the capacity of the cavity 141 is rapidly contracted (FIG. 6C). By the compression pressure generated inside the cavity 141 at this time, a portion of the ink (liquid material) filling the cavity 141 is discharged as ink droplets from the nozzle 110 in communication with this cavity 141.

By this series of operations (ink discharge operation by the drive signal of the head driver 33), the vibrating plate 121 of each cavity 141 does damped vibration from when the next drive signal (drive voltage) is input until ink droplets are discharged again. Following, this damped vibration is also called residual vibration.

The residual vibration of the vibrating plate 121 is assumed to be an item having the natural vibration frequency determined by the shape of the nozzle 110 and the ink supply port 142, or the acoustic resistance r due to the ink viscosity or the like, the inertance m due to the ink weight inside the flow path, and the compliance Cm of the vibrating plate 121.

Figure 7:
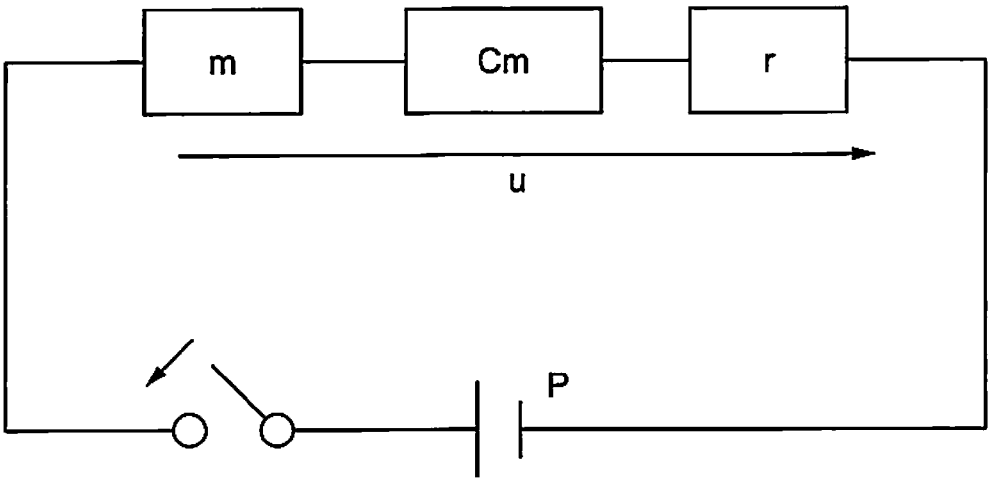
FIG. 7 is an equivalent circuit drawing showing a calculation model of simple harmonic vibration assuming the residual vibration of the vibrating plate of FIG. 3.

We will describe a calculation model for the residual vibration of the vibrating plate 121 based on the assumptions noted above. FIG. 7 is an equivalent circuit drawing showing a calculation model of simple harmonic vibration assuming the residual vibration of the vibrating plate 121.

In FIG. 7, the calculation model of the residual vibration of the vibrating plate 121 is expressed using acoustic pressure P, and the inertance m, the compliance Cm, and the acoustic resistance r described above. Also, when the step response when the acoustic pressure P is given to the equivalent circuit in FIG. 7 is calculated for the volume velocity u, the formula (calculation model) shown in equations (1) to (3) below is obtained.

Equations (1) to (3)

$$u = \frac{P}{\omega \cdot m} e^{-\alpha t} \cdot \sin\omega t \quad (1)$$

$$\omega = \sqrt{\frac{1}{m \cdot C} - \alpha^2} \quad (2)$$

$$\alpha = \frac{r}{2m} \quad (3)$$

Figure 8:
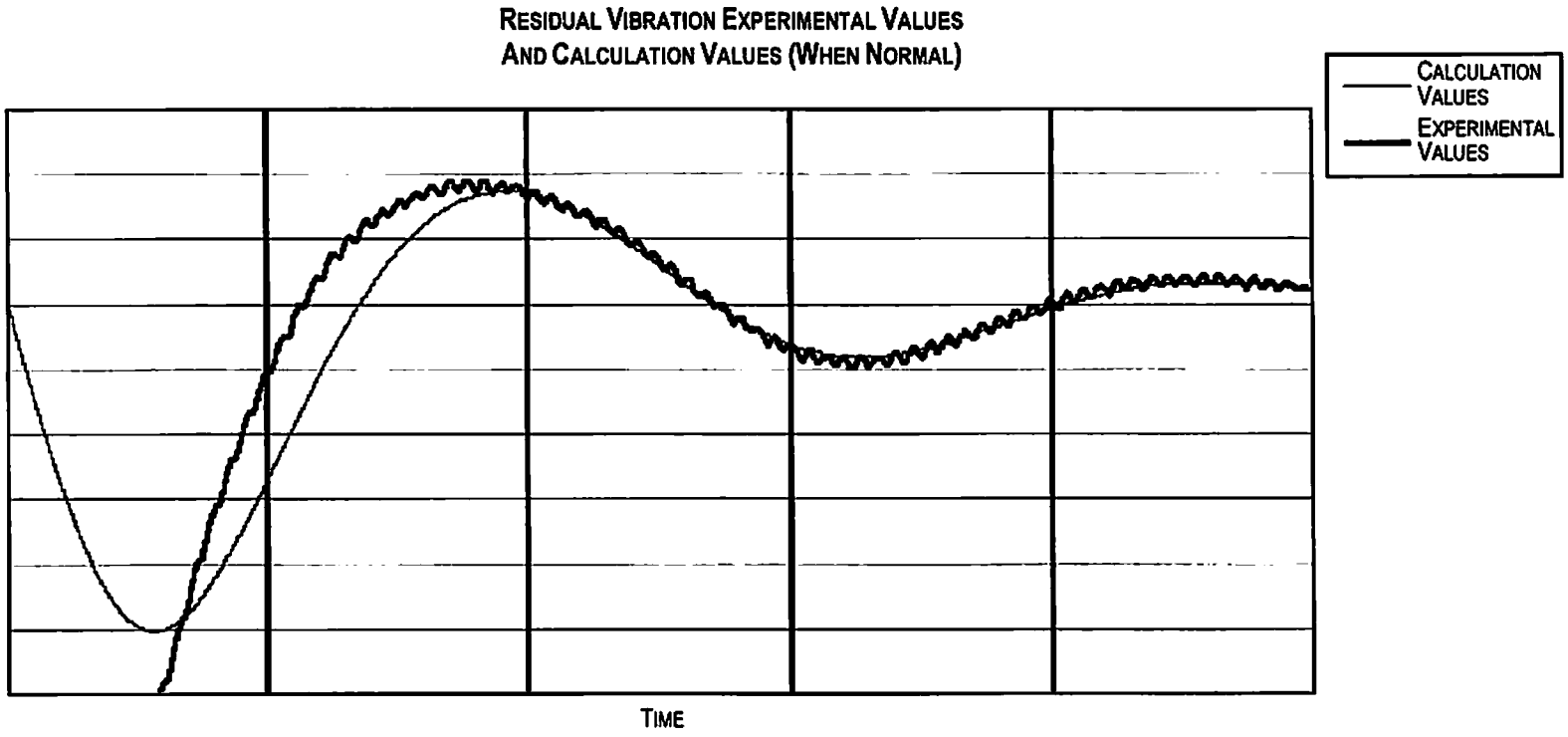
FIG. 8 is a graph showing the relationship between the vibration plate residual vibration experimental values and calculation values.

We will describe the results of comparing the calculation results obtained from the formula of equations (1) to (3) noted above, and the experiment results for the residual vibration experiment of the vibrating plate 121 after discharge of ink droplets performed separately. FIG. 8 is a graph showing the relationship between the experimental values and calculation values for the vibration plate 121 residual vibration. In FIG. 8, the horizontal axis shows time, and the vertical axis shows the size of the residual vibration. As can be understood from the graph shown in FIG. 8, the two waveforms of the experimental values and calculated values roughly match.

Now then, with each inkjet head 100 of the head unit 35, there are cases when a phenomenon of normal discharge of ink droplets from the nozzles 110 does not occur despite the kind of discharge operation described previously being performed, specifically, a droplet discharge abnormality occurs. When a discharge abnormality occurs, as a result, droplets are not discharged from the nozzle 110, specifically, the droplet non-discharge phenomenon appears, and missing dots of the pixels occur on the image printed (drawn) on the recording media P. Also, even when droplets are discharged from the nozzle 110, when the droplet flying direction (trajectory) is skewed and the desired image formation is not realized, this appears as missing dots of pixels. From this kind of situation, with the description below, there are cases when droplet discharge abnormalities are simply called "missing dots."

As a cause of discharge abnormalities occurring, we can list (1) mixing in of air bubbles inside the cavity 141, (2) drying or thickening (hardening) of the ink near the nozzle 110, (3) adhesion of foreign matter such as paper powder or the like near the outlet of the nozzle 110, and the like.

Figure 9:
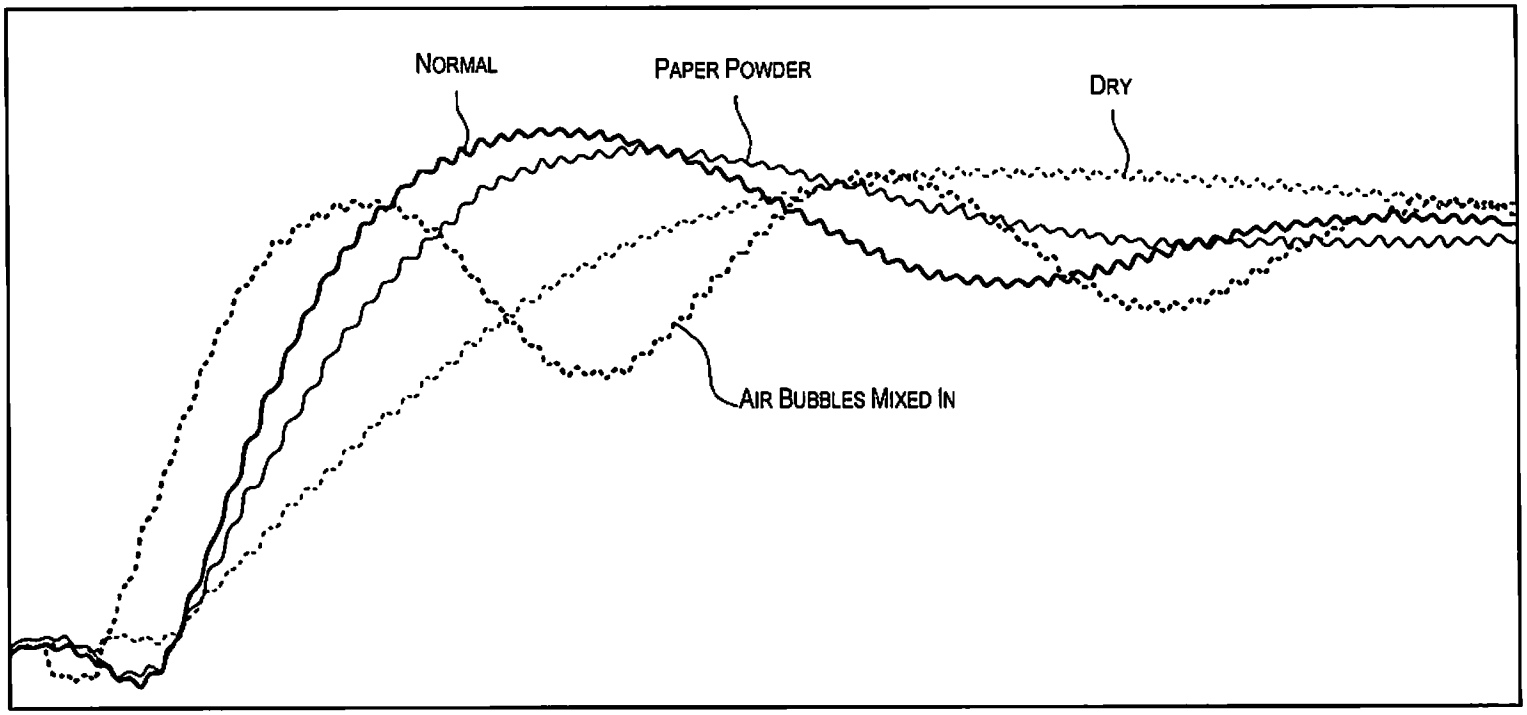
FIG. 9 is an explanatory drawing showing the state of the typical residual vibration for each state of each nozzle (inkjet head).

For the state of each nozzle 110 (including the state of the cavity 141) that could cause this kind of discharge abnormality, after pressure fluctuation when drive signals are applied to the electrostatic actuator 120 corresponding to each nozzle 110, it is possible to do detection from the state of the residual vibration (to be precise, the free vibration of the vibrating plate 121 in FIG. 3) generated within the cavity 141. Following, we will describe the state of the residual vibration of each state of the nozzle 110 noted above. FIG. 9 is an explanatory drawing showing the state of the typical residual vibration for each state of each nozzle 110 (inkjet head 100). The same as with FIG. 8 noted above, with FIG. 9 as well, the horizontal axis shows time, and the vertical axis shows the size of the residual vibration.

In FIG. 9, first, for residual vibration when air bubbles are mixed into the ink inside the cavity 141 or the nozzle 110 (correlates to "air bubbles mixed in" in the drawing), compared to the state of the residual vibration when the nozzle is normal (correlates to "normal" in the drawing), the inertance m due to the ink weight is reduced by the amount of air bubbles mixed in, and the acoustic resistance r is reduced as this is equivalent to the state when the nozzle diameter becomes larger due to air bubbles, and there is the feature of the vibration frequency increasing.

Also, when the ink of the nozzle part dries (correlating to "dry" in the drawing), the acoustic resistance r increases due to an increase in the viscosity of the ink, and there is the feature of there being excessive damping (the frequency of the damping vibration becomes lower).

Also, when foreign matter such as paper powder, debris or the like is adhered to the nozzle surface (correlates to "paper powder" in the drawing), by the ink from the nozzle seeping out due to the paper powder, the ink weight seen from the vibrating plate 121 increases and the inertance m increases, and the acoustic resistance r increases due to the fibers of the paper powder adhered to the nozzle 110, and there is the characteristic of the cycle becoming larger (the frequency becomes lower).

Here, in the case when the ink near the nozzle 110 dries and the viscosity increases, and the case when paper powder adheres near the outlet of the nozzle 110, in either case, compared to when the ink droplets are discharged normally, the damping vibration frequency becomes lower. These two causes of missing dots (ink not discharged: discharge abnormality) are identified from the waveform of the residual vibration of the vibrating plate 121, so for example it is possible to compare using a designated threshold value for the damping vibration frequency, cycle, or phase, or to identify from the damping factor of the cycle change or amplitude change of the residual vibration (damping vibration). Working in this way, it is possible to detect discharge abnormalities of each inkjet head 100 by changes in the residual vibration of the vibration plate 121, particularly changes in the frequency, when the ink droplets are discharged from the nozzle 100 with each inkjet head 100. Also, it is possible to identify the cause of the discharge abnormality by comparing the frequency of the residual vibration in that case and the residual vibration when the discharge is normal.

Also, as described previously, when air bubbles are mixed in inside the cavity 141 of the inkjet head 100, the frequency is higher than the residual vibration waveform of the vibrating plate 121 when the discharge is normal, so from the feature of that frequency cycle conversely being shorter than the cycle of the residual vibration during normal discharge, it is possible to identify the cause of the discharge abnormality as items due to air bubbles being mixed in.

Discharge Abnormality Detection Unit

Figure 10:
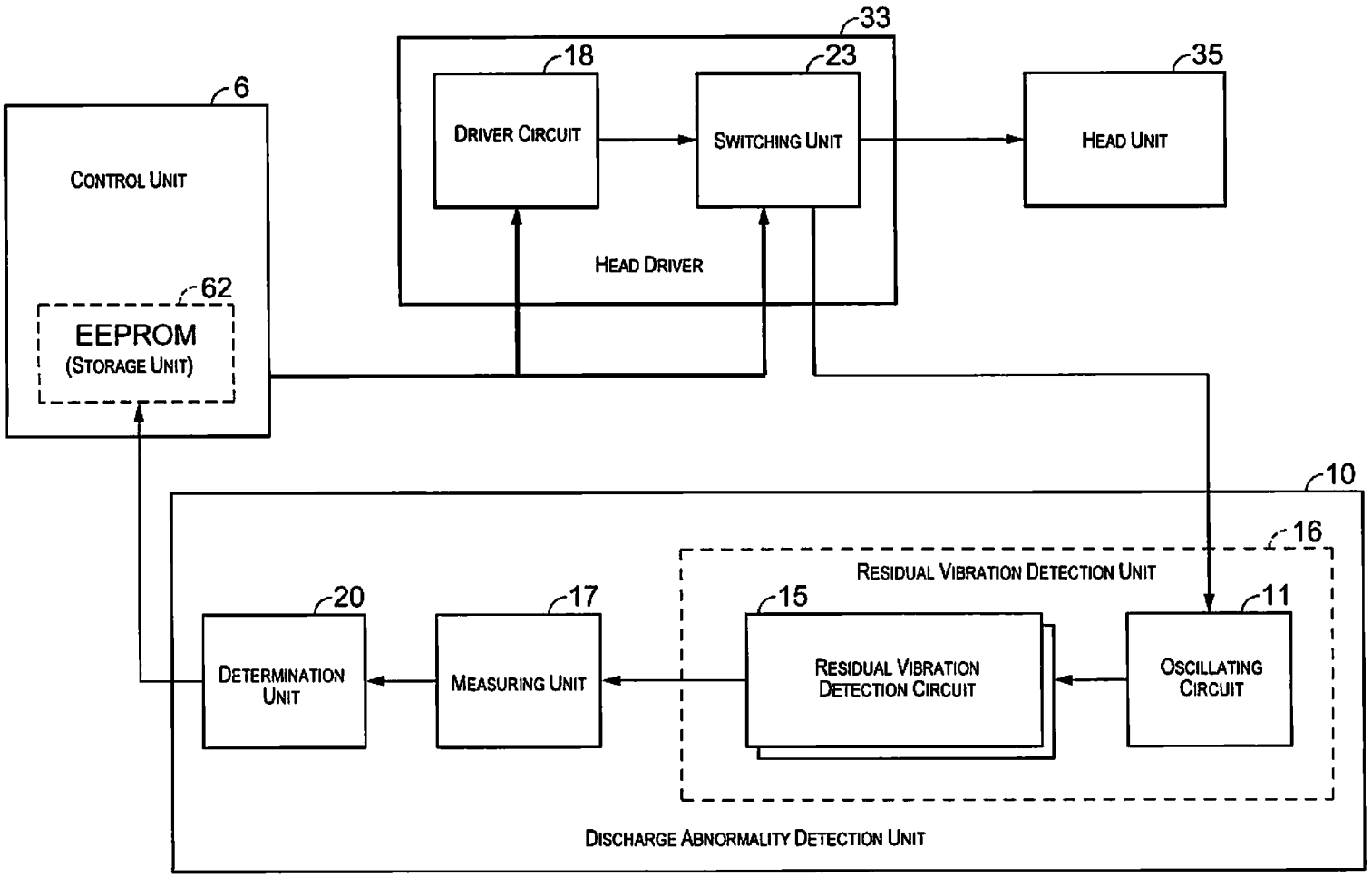
FIG. 10 is a schematic block diagram of the discharge abnormality detection unit for the inkjet printer shown in FIG. 2.

Next, we will describe the discharge abnormality detection unit 10 for detecting the presence or absence and the cause of the discharge abnormalities noted above. FIG. 10 is a schematic block diagram of the discharge abnormality detection unit 10 for the inkjet printer 1 shown in FIG. 2.

As shown in FIG. 10, the discharge abnormality detection unit 10 is equipped with a residual vibration detection unit 16 constituted from an oscillating circuit 11 a residual vibration detection circuit 15 including an F/V conversion circuit, waveform shaping circuit or the like, a measuring unit 17 for measuring the cycle, amplitude or the like from the residual vibration waveform data detected by this residual vibration detection unit 16, and a determination unit 20 for determining the discharge abnormality of the inkjet head 100 based on the cycle or the like measured by the measuring unit 17.

With the discharge abnormality detection unit 10, based on the residual vibration of the vibrating plate 121 of the electrostatic actuator 120, the residual vibration detection unit 16 has the oscillating circuit 11 oscillate, forms a vibration waveform at the residual vibration detection circuit 15 from that oscillation frequency, and does detection. Then, the measuring unit 17 measures the state of the cycle or the like of the residual vibration based on the oscillation waveform that was detected, and the determination unit 20 detects and determines the presence or absence and the cause of the discharge abnormality of each inkjet head 100 that each head unit 35 inside the printing unit 3 is equipped with.

Figure 11:
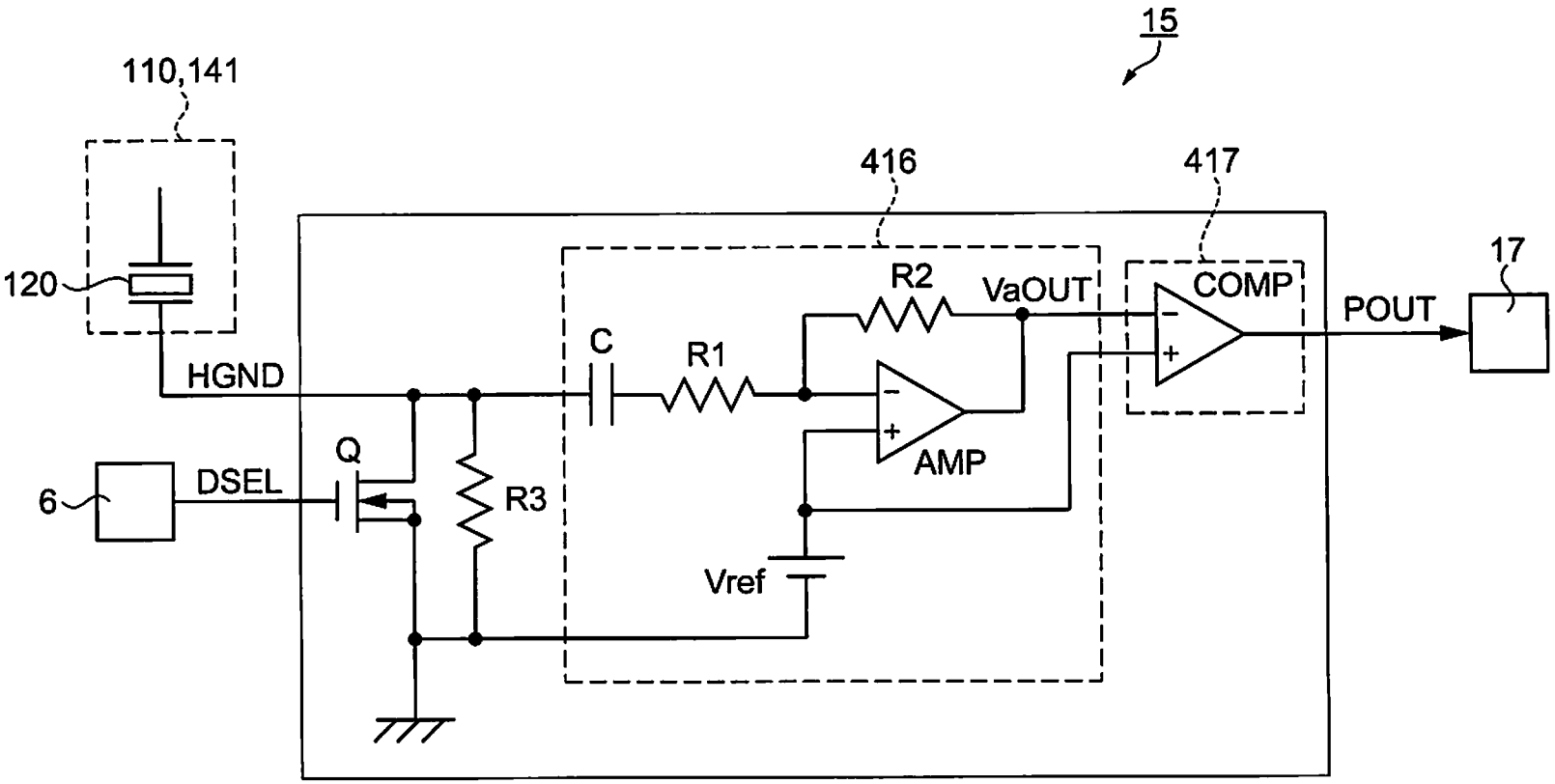
FIG. 11 is a circuit diagram showing an example of the residual vibration detection circuit with the discharge abnormality detection unit shown in FIG. 10.

FIG. 11 is a circuit diagram showing an example of the residual vibration detection circuit 15 with the discharge abnormality detection unit 10 shown in FIG. 10.

The residual vibration detection circuit 15 is a part that detects residual vibration using the fact that pressure changes of the ink inside the cavity 141 are transmitted to the electrostatic actuator 120. In specific terms, changes in the electromotive force (electromotive voltage) generated by the mechanical displacement of the electrostatic actuator 120 are detected.

The residual vibration detection circuit 15 is constituted including a transistor Q, an alternating current amplifier 416, a comparator 417 and the like.

The transistor Q is a switch that grounds or opens the ground terminal of the electrostatic actuator 120 (HGND application side), and its gate voltage (gate signal DSEL) is controlled by the control unit 6. The resistor R3 is provided to inhibit rapid voltage changes when switching the transistor Q on and off.

The alternating current amplifier 416 is constituted by a capacitor C for removing the direct current component, and a functional unit AMP for inversion amplifying at an amplification rate determined by resistors R1 and R2 with the electric potential of the reference voltage Vref as the reference. The alternating current amplifier 416 amplifies the alternating current component of the generated residual vibration by opening the ground terminal after applying the drive signal pulse to the electrostatic actuator 120.

The comparator 417 is a comparator for comparing the amplified residual vibration VaOUT and the reference voltage Vref, and outputs the pulse POUT of the cycle according to the residual vibration.

When the gate signal DSEL goes to high level, the transistor Q turns on, the ground terminal of the electrostatic actuator 120 goes to a grounded state, and the drive signals are supplied to the electrostatic actuator 120. Conversely, when the gate voltage of the transistor Q (gate signal DSEL) goes to low level, the transistor Q turns off, and the electromotive force of the electrostatic actuator 120 is transmitted to the residual vibration detection circuit 15.

The residual vibration detection circuit 15 outputs to the measuring unit 17 the pulse POUT of a cycle according to the residual vibration VaOUT for which the electromotive force signal was amplified by the residual vibration.

Returning to FIG. 10, we will describe the switching timing between the ink droplet discharge operation (driving) of the inkjet head 100 of the head unit 35 (see FIG. 3) and the discharge abnormality detection operation (drive stopped). Here, we will describe the drive circuit 18 inside the head driver 33 as the drive circuit of the inkjet head 100, and will describe the detailed constitution below of the inkjet head 100 of the head unit 35 while referring to FIG. 3, and the detailed constitution of the residual vibration detection circuit 15 while referring to FIG. 11.

With FIG. 10, the discharge abnormality detection process noted above is executed between drive signals of the inkjet head 100, specifically, in the drive stop period.

Here, the switching unit 23 drives the electrostatic actuator equipped in each inkjet head 100 of the head unit 35, so initially it is connected to the drive circuit 18 side. When the drive signal (voltage signal) from the drive circuit 18 is input to the vibrating plate 121, it drives the electrostatic actuator 120, and the vibrating plate 121 is attracted to the segment electrode 122 side, and when the applied voltage is 0, there is a rapid displacement to the direction separating from the segment electrode 122, and vibration (residual vibration) starts. At this time, ink droplets are discharged from the nozzle 110 of the inkjet head 100. At this time, the drive circuit 18 functions as a drive unit that outputs drive signals to the piezoelectric element.

When the drive signal pulse falls, a drive/detection switching signal is input to the switching unit 23 synchronous with the falling edge of that signal waveform, and the switching unit 23 switches from the drive circuit 18 to the discharge abnormality detection unit (detection circuit) 10 side, and the electrostatic actuator 120 (used as the capacitor for the oscillating circuit 11) is connected with the discharge abnormality detection unit 10.

Also, the discharge abnormality detection unit 10 executes the kind of discharge abnormality (missing dot) detection process described above, and the residual vibration waveform data (square wave data) of the vibrating plate 121 output from the comparator 417 of the residual vibration detection circuit 15 is put into numerical value form such as the residual vibration waveform cycle, amplitude or the like by the measuring unit 17. With this embodiment, the measuring unit 17 measures specific vibration cycles from the residual vibration waveform data, and outputs those measurement results (numerical values) to the determination unit 20.

The determination unit 20 determines the presence or absence of discharge abnormalities, the cause of the discharge abnormality, the comparative deviation amount or the like based on specific vibration cycles or the like (measurement results) of the residual vibration waveform measured by the measuring unit 17, and outputs those determination results to the control unit 6. The control unit 6 saves these determination results in a designated storage area of the EEPROM (storage unit) 62. Then, at the timing when the next drive signal is input from the drive circuit 18, the drive/detection switching signal is again input to the switching unit 23, and the drive circuit 18 and the electrostatic actuator 120 are connected. When a drive voltage is applied once, the drive circuit 18 maintains the ground (GND) level, and performs the kind of switching noted above using the switching unit 23. By doing this, without being affected by disturbance or the like from the drive circuit 18, it is possible to accurately detect the residual vibration waveform of the vibrating plate 121 of the electrostatic actuator 120. "Detecting discharge abnormalities" can also be said as "testing for discharge abnormalities." In other words, as a result of testing if there is an abnormality, an abnormality is detected, and if there is no abnormality, an abnormality is not detected. Therefore, the discharge abnormality detection unit 10 can be said to be a testing unit for testing for discharge abnormalities of the nozzle 110 based on the vibration pattern of the residual pattern inside the pressure chamber 141 generated by the drive signal.

Recovery Unit

Figure 12:
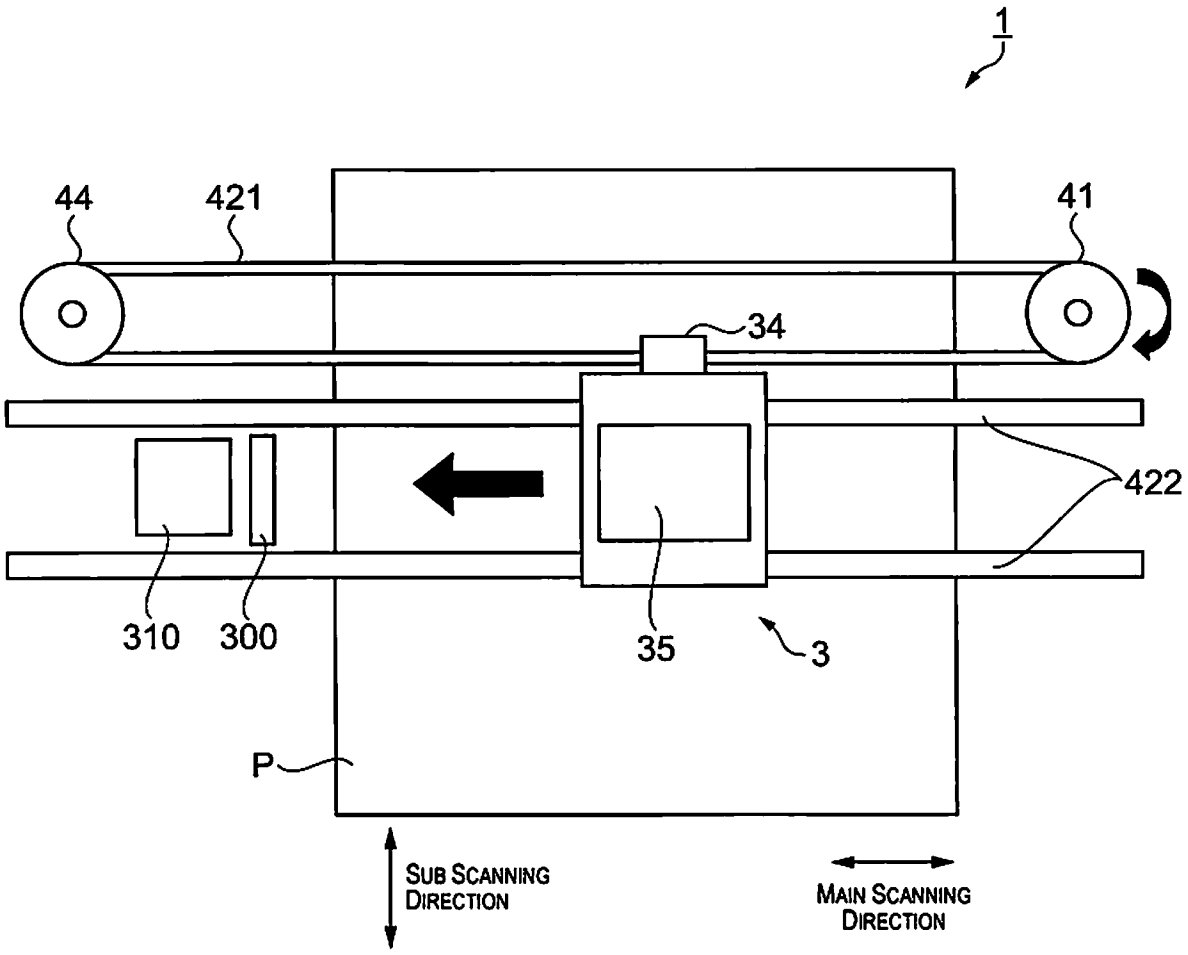
FIG. 12 is an explanatory drawing showing the schematic structure (with a portion omitted) seen from the top part of the inkjet printer shown in FIG. 1.

Next, we will describe the recovery unit 24 for executing recovery processing that eliminates the cause of discharge abnormalities (head abnormalities) detected by the discharge abnormality detection process by the discharge abnormality detection unit 10 described above on the inkjet head 100 (head unit 35) with the liquid discharge device of the present invention. FIG. 12 is an explanatory drawing showing the schematic structure (with a portion omitted) seen from the top part of the inkjet printer 1 shown in FIG. 1. In addition to the constitution shown with the perspective view of FIG. 1, the inkjet printer 1 shown in this FIG. 12 is equipped with a wiper 300 and a cap 310 for executing the recovery process for non-discharge of ink droplets (head abnormality).

As the recovery process executed by the recovery unit 24, included are a flushing process for preliminarily discharging droplets from the nozzles 110 of each inkjet head 100, a wiping process by the wiper 300, and a pumping process (pump suction process) by a tube pump (not illustrated).

The recovery unit 24 is equipped with a tube pump and a pulse motor that drives that, the wiper 300 and a vertical movement drive mechanism for the wiper 300, and a vertical movement drive mechanism (not illustrated) for the cap 310, and with the flushing process, the head driver 33, the head unit 35 and the like function as a part of the recovery unit 24, and with the wiping process, the carriage motor 41 or the like functions as a part of the recovery unit 24.

The wiping process means a process of using the wiper 300 to wipe foreign matter such as paper powder or the like that has adhered to the nozzle plate 150 (nozzle surface) of the head unit 35.

Also, the pumping process (pump suction process) means a process of driving the tube pump and suctioning and exhausting ink within the cavity 141 from each nozzle 110 of the head unit 35.

In this way, the wiping process is a suitable process as a recovery process for a state when foreign matter such as paper powder is adhered which is one cause of liquid discharge abnormalities of the kind of inkjet head 100 described above. Also, the pump suction process is a suitable process as a recovery process for removing air bubbles inside the cavity 141 that cannot be removed with the flushing process described previously, or for removing thickened ink when ink near the nozzle 110 or within the cavity 141 has thickened. When thickening has not progressed that far and the viscosity is not that high, the recovery process using the flushing process described above is also possible, and in this case, the exhausted ink volume is low, so it is possible to perform suitable recovery processing without lowering the throughput.

The plurality of head units 35 are placed in the carriage 32 which is guided by two carriage guide shafts 422, and moved by the carriage motor 41 linked to the timing belt 421 via a coupling unit 34 equipped on the top end of that in the drawing. The head units 35 placed in the carriage 32 can be moved in the main scan direction via the timing belt 421 (in conjunction with the timing belt 421) that is moved by driving of the carriage motor 41. The carriage motor 41 plays a role as a pulley for continuously rotating the timing belt 421, and similarly a pulley 44 is equipped at the other end side.

The cap 310 is for performing capping of the nozzle plate 150 of the head unit 35 (see FIG. 5). On the cap 310, a hole is provided on the bottom side surface, and to that hole is connected a flexible tube (not illustrated) which is the tube pump constitutional element.

In FIG. 12, during the recording (printing) operation of the inkjet printer 1, while driving the electrostatic actuator 120 of a designated inkjet head 100 (head), the recording media P is moved in the sub scan direction, specifically, the downward direction in FIG. 12, and by the printing unit 3 moving in the main scan direction, specifically, the lateral direction in FIG. 12, the inkjet printer (droplet discharge device) 1 prints (records) on the recording media P a designated image or the like based on print data (printing data) input from the host computer 8.

Figure 15A:
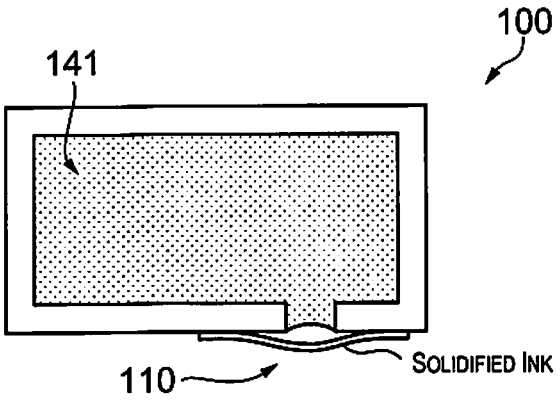
FIGS. 15A to 15C are schematic cross section views schematically showing the transition of the state of the inkjet head with the detection and determination method of discharge abnormalities due to fine foreign matter adhesion on the nozzle surface.

Discharge Abnormality Detection Method Using Fine Foreign Matter Adhesion on the Nozzle Surface However, as a cause of discharge abnormalities for which discharge abnormalities cannot be eliminated even with the recovery process by the recovery unit 24 described above, there is the adhesion of fine foreign matter to the nozzle surface of the inkjet head 100. In particular, as fine foreign matter adhered relatively strongly to the nozzle surface, there is the adhesion of solidified ink as shown in FIG. 15A. The adhesion of solidified ink is caused when hardening of the ink adhered to the nozzle surface of the inkjet head 100 progresses and solidifies, or when solidified ink that solidified at other sites is moved to the nozzle surface by the recovery process or the like and becomes adhered again.

When this kind of solidified ink adheres at a position that interferes with the trajectory of discharged ink droplets of the nozzles 110 of the nozzle surface of the inkjet head 100 or their vicinity, this can be a cause of a discharge abnormality. In fact, in many cases the solidified ink is in a very thin film state or is very tiny, so with the discharge abnormality detection process using the detection of residual vibration described above, it is difficult to detect that because the difference in the residual vibration waveform in relation to normal times is extremely small. Because of this, printing of images using the inkjet printer 1 may start again while still in a state with the discharge abnormality occurring without being able to detect the cause of the discharge abnormality that remains after recovery processing, for example, and there is the risk of producing a large volume of defective printed matter.

In light of that, with the discharge abnormality detection method of this embodiment, after executing the air bubble trapping operation of trapping air bubbles inside the cavity 141 when foreign matter exists that can be a cause of discharge abnormalities on the nozzle surface, the residual vibration detection process is implemented. By executing the step using the air bubble trapping unit, when air bubbles are trapped in the cavity 141 (including the ink flow path up to the nozzle tip) (the air bubble mixing in mode described above), for detection of the residual vibration, the difference with the vibration waveform of the normal time appears clearly, so it is possible to reliably detect discharge abnormalities due to adhesion of foreign matter on the nozzle surface.

At this time, the control unit 6 controls each part of the inkjet printer 1 and executes the operation for detecting discharge abnormalities.

Figure 13:
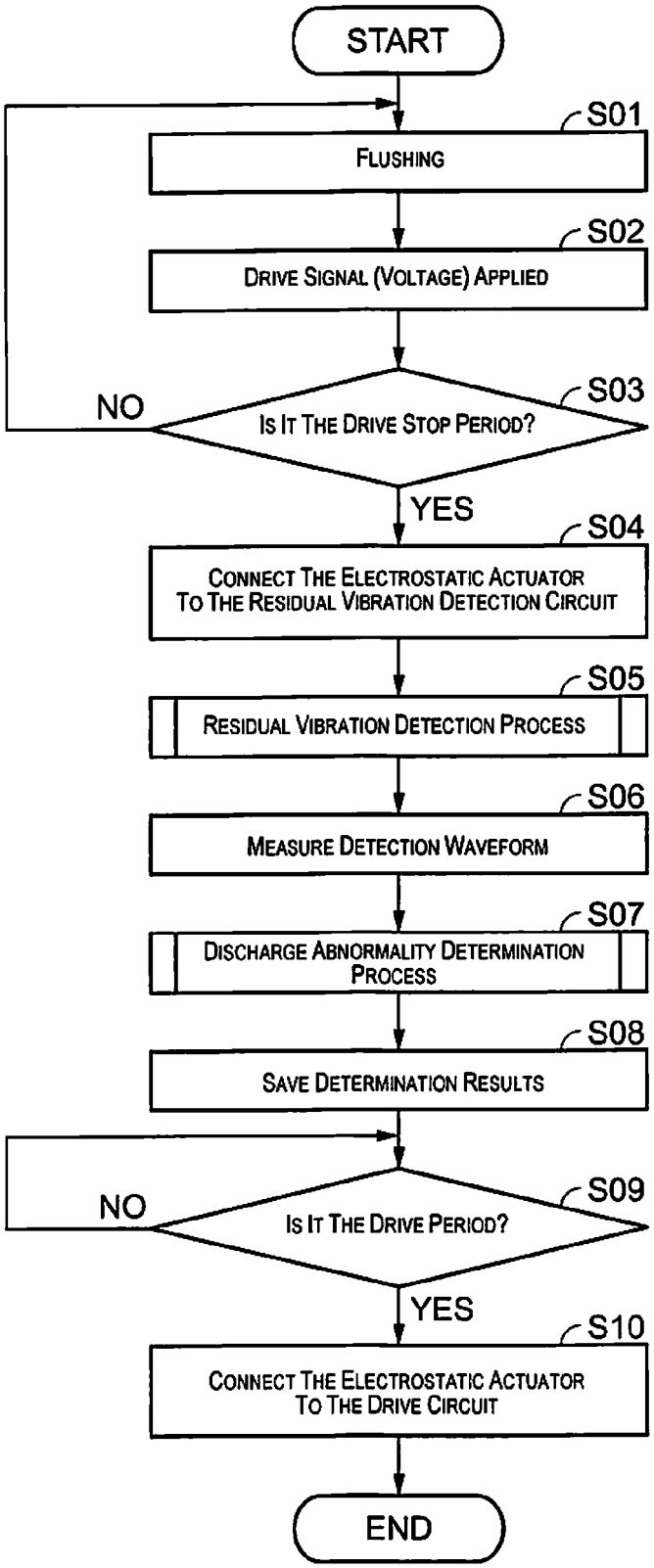
FIG. 13 is a flow chart showing the method of detecting discharge abnormalities due to fine foreign matter (solidified ink) adhesion on the inkjet head nozzle surface.
Figure 14A:
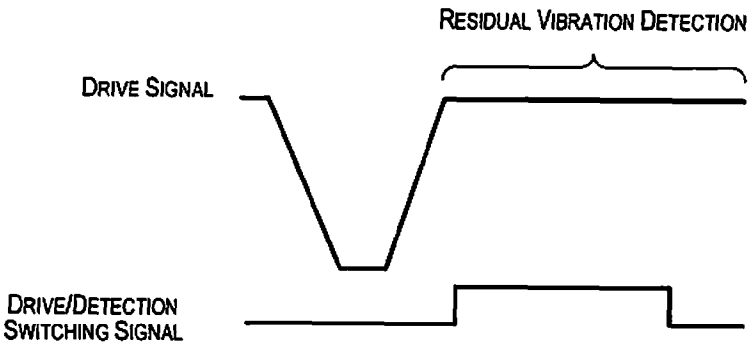
FIG. 14A is an explanatory drawing schematically showing an example of the amplitude of the drive signal used with the normal residual vibration detection process.
Figure 14B:
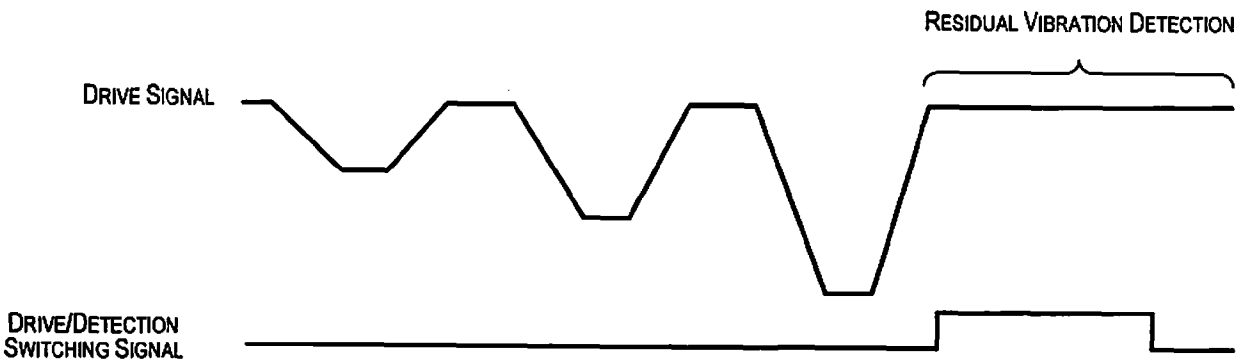
FIG. 14B is an explanatory drawing schematically showing the amplitude of the drive signal used with the residual vibration detection process with the detection and determination method of discharge abnormalities due to fine foreign matter adhesion of the nozzle surface.

Following, while referring to the drawings, we will describe the method of detecting discharge abnormalities due to adhesion of fine foreign matter on the nozzle surface like that noted above, using discharge abnormality detection processing by the residual vibration detection described above. FIG. 13 is a flow chart showing the method of detecting discharge abnormalities due to adhesion of fine foreign matter (solidified ink) on the nozzle surface of the inkjet head 100. Also, FIGS. 14A and 14B are for describing the drive waveform applied with the residual vibration detection process, where FIG. 14A is an explanatory drawing schematically showing an example of the drive signal waveform used with the normal residual vibration detection process, and FIG. 14B is an explanatory drawing schematically showing the drive signal waveform used with the residual vibration detection process with the detection method of discharge abnormalities due to fine foreign matter adhesion of the nozzle surface. Also, FIG. 15 is a schematic cross section view schematically showing the transition of the state of the inkjet head 100 with the detection method of discharge abnormalities due to fine foreign matter adhesion of the nozzle surface.

Figure 15B:
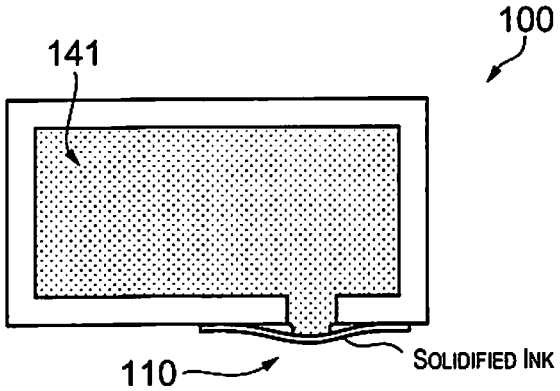

Following, we will describe the discharge abnormality detection process for the nozzle 110 of one inkjet head 100, but for convenience of the description, with the flow chart shown in FIG. 13, shown is the discharge abnormality detection process corresponding to the discharge operation of one inkjet head 100, specifically, one nozzle 110. FIG. 15A schematically shows the state of solidified ink as a fine foreign matter which can be a cause of discharge abnormalities adhered to the nozzle surface on which the nozzle 110 of one inkjet 100 is formed. For this kind of foreign matter adhesion to the nozzle surface, with the discharge abnormality detection method of this embodiment, first, at step S01 in FIG. 13, the flushing process which is one recovery process of the recovery unit 24 (see FIG. 2) is executed. This flushing process is an operation that wets the nozzle surface. As shown in FIG. 15B, with this flushing process, the nozzle surface is wet with ink, and the ink reaches the solidified ink. The wetting method using ink for the solidified ink on the nozzle surface is not limited to the kind of state in FIG. 15B, and a different state is shown for the wetting method using the solidified ink size, shape (positional relationship or size of the gap in relation to the nozzle 110) or the like, but in any of the states, when the ink reaches the solidified ink using the flushing process, the ink meniscus of that nozzle 110 is in a broken state in relation to when there is no foreign matter such as solidified ink or the like.

Next, the drive signal for residual vibration detection is input from the drive circuit 18 of the head driver 33 shown in FIG. 10, and based on the timing of that drive signal, the drive signal (voltage signal) is applied between both electrodes of the electrostatic actuator 120 (see FIG. 11) of the head unit 35 (step S02 in FIG. 13). Then, based on the drive/detection switching signal, the control unit 6 determines whether or not the inkjet head 100 that did discharge is in the drive stop period (step S03). Here, the drive/detection switching signal goes to high level synchronous with the falling edge of the drive signal, and is input from the control unit 6 to the switching unit 23.

When the drive/detection switching signal is input to the switching unit 23, the capacitor that constitutes the electrostatic actuator 120, specifically, the oscillating circuit 11, is disconnected from the drive circuit 18 by the switching unit 23, and connected to the discharge abnormality detection unit 10 (detection circuit) side, specifically, the oscillating circuit 11 of the residual vibration detection unit 16 (step S04). Then, the residual vibration detection process is executed (step S05).

Here, we will describe the drive waveforms applied with the residual vibration detection process from step S02 to step S05.

First, we will describe the drive signal waveform (drive waveform) applied with the normal residual vibration detection process. FIG. 14A shows an example of a drive signal waveform used with the normal residual vibration detection process described above, specifically, the residual vibration detection process for detecting and determining discharge abnormalities due to (1) mixing in of air bubbles inside the cavity 141, (2) drying or thickening (adhering) of ink near the nozzle 110, (3) adhesion of foreign matter such as paper powder or the like near the outlet of the nozzle 110 and the like. Also, the signal under the drive signals is the drive/detection switching signal described previously. As shown in this drawing, with the drive signal applied with the normal residual vibration detection process, after there is one fall of the drive waveform, and after a flat interval, the drive waveform rises again, and the residual vibration detection process is executed at a designated voltage.

In contrast to this, FIG. 14A shows an example of the drive signal waveform of the residual vibration detection process of this embodiment. Also, the signal under the drive signal is the drive/detection switching signal described previously. With this embodiment, as shown in FIG. 14B, after several times of the drive waveform fall, flat interval, and rise (three times with this embodiment), the residual vibration detection process is executed at a designated voltage. In other words, the drive signal has several times of vibrations. In fact, the size of the three times of falling is gradually larger as it progresses from the first time to the third time, and the residual vibration detection process is performed by applying a so-called excitation waveform drive signal.

It is preferable for the drive signal waveform applied with the residual vibration detection process to be a waveform that resonates with the natural vibration of the cavity 141 because that makes it easier to trap air bubbles in the cavity 141.

Figure 15C:
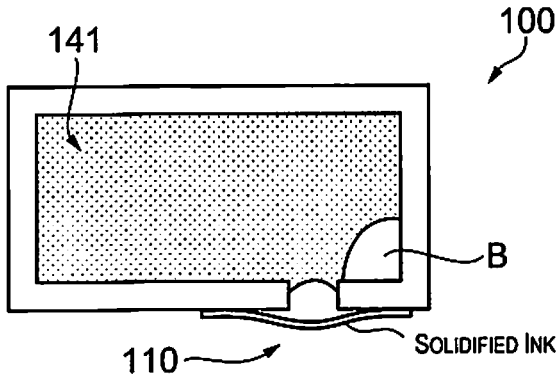

As described above, in a state with the nozzle surface wet with ink by the flushing process of step S01, when the excitation waveform drive signal shown in FIG. 14B is applied, when foreign matter such as solidified ink has adhered on the nozzle 110 of the nozzle surface or in that vicinity, when the ink that wet the nozzle surface returns to the nozzle 110 (cavity 141), the return of the ink that was contacting the solidified ink is disturbed and the ink meniscus balance of the nozzle 110 is broken, and mixing in of air bubbles in the ink inside the nozzle 110 or inside the cavity 141 occurs (see FIG. 15C). In particular with this embodiment, by applying a drive signal of a waveform having a plurality of times (three times) of falling and rising, when solidified ink (foreign matter) adheres to the nozzle surface, it is possible to more reliably trap air bubbles in the ink inside the nozzle 110 or inside the cavity 141.

In fact, the size of the fall for the plurality of times of falling and rising of the drive signal is an excitation waveform that gradually becomes larger from the first time to the third time. This is because when a waveform is applied having a large amplitude vibration all of a sudden from the first time, the nozzle meniscus is greatly broken, and there is the risk of air bubbles being trapped in the ink inside the nozzle 110 or inside the cavity 141 due to causes other than adhesion of foreign matter to the nozzle surface. Therefore, an excitation waveform that gradually becomes larger for which the vibration amplitude gradually becomes larger is given, so it is possible to inhibit trapping of air bubbles inside the nozzle 110 or inside the cavity 141 due to causes other than adhesion of foreign matter on the nozzle surface.

The ink wetting state of the nozzle surface with the flushing process of step S01 changes together as time passes, and eventually the effect as one air bubble trapping operation disappears, so the time from the flushing process until the residual vibration detection process (step S02 to S05) is managed within a designated time, within for example several seconds.

After the residual vibration detection process of step S05, the measuring unit 17 measures designated numerical values from the residual vibration waveform data detected with that residual vibration detection process (step S06). Here, the measuring unit 17 measures the residual vibration cycle, phase difference, amplitude and the like from the residual vibration waveform data.

Next, the discharge abnormality determination process described later is executed based on the measurement results of the measuring unit 17 by the determination unit 10 (step S07).

Figure 16:
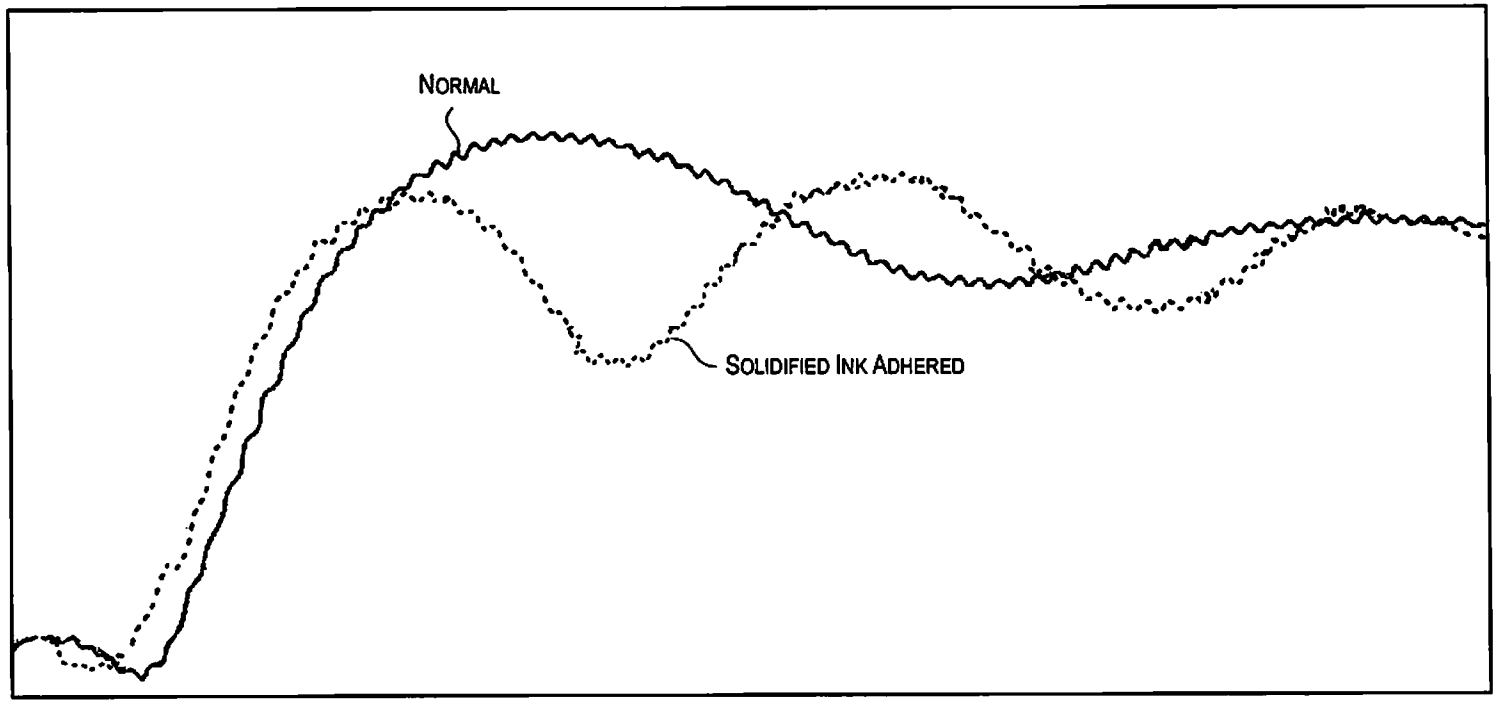
FIG. 16 is an explanatory drawing showing the typical residual vibration waveform data obtained with the residual vibration detection process.

FIG. 16 is an explanatory drawing showing the typical residual vibration waveform data obtained with the residual vibration detection process of this embodiment. As shown in FIG. 16, with the discharge abnormality detection method of this embodiment, the solidified ink (foreign matter adhesion) of the nozzle surface is able to be detected as the detection waveform of the "air bubbles mixed in" described above. Specifically, compared to the state of residual vibration when the nozzle is normal (correlates to "normal" in the drawing), the residual vibration detected with the residual vibration detection process, the inertance m due to the ink weight is reduced, the acoustic resistance r is reduced as this is equivalent to the state when the nozzle diameter becomes larger due to air bubbles, and the vibration frequency becomes higher, and it is possible to reliably detect this as an abnormality.

The determination results of the discharge abnormality determination process of step S07 is saved in a designated storage area of the EEPROM (storage unit) 62 of the control unit 6.

Then, at step S09, a determination is made of whether or not the inkjet head 100 is in the drive period. Specifically, the drive stop period ends, it is determined whether or not the next drive signal has been input, and this step S09 is in standby until the next drive signal is input.

At the timing that the next drive signal pulse is input, when the drive/detection switching signal goes to low level synchronous with the rising edge of the drive signal ("yes" at step S09), the switching unit 23 switches the connection with the electrostatic actuator 120 from the discharge abnormality detection unit (detection circuit) 10 to the drive circuit 18 (step S10), and one series of the discharge abnormality detection process ends.

With the discharge abnormality detection method of the embodiment noted above, the nozzle surface is wet with ink by executing the flushing process, so by applying an excitation waveform drive signal, when there is adhesion of foreign matter such as solidified ink or the like on the nozzle surface, the step of trapping air bubbles in the ink inside the nozzle 110 or in the cavity 141 is executed, and by detecting mixing in of air bubbles using the residual vibration detection process, discharge abnormalities are detected due to fine foreign matter such as solidified ink or the like adhering to the nozzle surface. When air bubbles have been trapped in the ink inside the nozzle 110 or inside the cavity 141, compared to the state of the residual vibration when the nozzle is normal, the inertance m due to the ink weight is reduced, and the acoustic resistance r is reduced as this is equivalent to the state when the nozzle diameter becomes larger due to air bubbles, the vibration frequency becomes higher, and it is possible to reliably detect this as an abnormality.

Therefore, it is possible to provide the inkjet printer 1 capable of reliably detecting discharge abnormalities due to adhesion of fine foreign matter on the nozzle surface which are difficult to detect with the normal mode of adhesion of foreign matter such as paper powder or the like, and capable of avoiding the occurrence of continuous printing defects.

When the inkjet printer 1 is a device of the type that uses ink including a photo-initiator and cures the ink using a UV light source or the like, it is easy for solidified ink to occur on the nozzle surface. Therefore, with a device of the type that uses ink including a photo-initiator and cures ink using a UV light source or the like, it is particularly effective to test for discharge abnormalities of the nozzles 110 after performing the air bubble trapping operation like that noted above.

Here, we will summarize below the operation for detecting discharge abnormalities due to the adhesion of foreign matter on the nozzle surface.

First, the drive unit outputs the first drive signal, and exhausts liquid from the nozzle 110. Here, "exhausts" includes discharging liquid from the nozzle 110 and exuding liquid from the nozzle 110. Next, the drive unit outputs the second drive signal, and vibrates the vibrating plate 121. Next, the testing unit tests for discharge abnormalities of the nozzle 110 based on the vibration pattern of the residual vibration inside the pressure chamber 141 that occurred due to the second drive signal.

Therefore, the control unit 6 executes the operation of having the drive unit output the second drive signal after it outputs the first drive signal, and after that, has the testing unit test for discharge abnormalities of the nozzle 110. By performing testing for the discharge abnormalities of the nozzle 110 after the first drive signal and the second drive signal are output, it is possible to test for the discharge abnormalities of the nozzle 100 in a state with a wider difference between the vibration pattern of the residual vibration of a normal nozzle 110 and the vibration pattern of the residual vibration of an abnormal nozzle 110.

This is due to the kind of action described below. There is a state with liquid existing between the nozzle 110 and foreign matter adhered to the nozzle 110 due to the liquid exhausted from the nozzle 110 based on the first drive signal. In light of that, liquid is exhausted from the nozzle 110 based on the second drive signal, and the liquid is strongly vibrated between the nozzle 110 and the foreign matter adhered to the nozzle 110. By doing this, the liquid surface (meniscus) of the nozzle 110 is broken, and air bubbles enter into the nozzle 110 or into the pressure chamber 141 in communication with the nozzle 110. With the nozzle 110 in which air bubbles have entered, the vibration pattern of the residual vibration changes from the normal time, so by performing testing using the testing unit at this timing, it is possible to detect the nozzle 110 for which foreign matter has adhered. This action is described for the nozzle 110 to which foreign matter has adhered, and this action does not occur on the nozzle 110 for which foreign matter has not adhered.

The first drive signal with the operation noted above is sufficient as long as it is a drive signal that has the liquid exhausted from the nozzle 110. For example, it can be an item that has liquid discharged from the nozzle 110 as droplets, or can be an item that has liquid exuded from the nozzle 110. By doing this, for nozzles 110 for which foreign matter has adhered, it is possible to set a state for which liquid exists between the nozzle 110 and the foreign matter adhered to the nozzle 110.

Also, the second drive signal is preferably a drive signal of a resonance waveform that resonates with the natural vibration of the pressure chamber 141. By doing this, it is possible to broaden the difference between the vibration pattern of the residual vibration of a normal nozzle 110 and the vibration pattern of the residual vibration of an abnormal nozzle 110.

At this time, the waveform of the first drive signal can be the same as or different from the waveform of the second drive signal.

Also, the resonance waveform has vibration N times (N is an integer of 2 or greater). By doing this, it is easier for the meniscus of the liquid on the nozzle 110 for which foreign matter has adhered to break, and it is possible to further broaden the difference between the vibration pattern of the residual vibration of a normal nozzle 110 and the vibration pattern of the residual vibration of an abnormal nozzle 110.

Also, with the resonance waveform, the amplitude of the Nth time vibration is preferably made to be larger than the amplitude of the first vibration. By working in this way, it is possible to prevent a large break all at once of the meniscus of the liquid on the nozzle for which foreign matter has adhered.

The operation for detecting discharge abnormalities due to adhesion of foreign matter on the nozzle surface can also be said to be an operation of performing testing using the testing unit after trapping air bubbles inside the foreign matter adhesion nozzle which is the nozzle 110 to which foreign matter has adhered, or inside the pressure chamber in communication with the foreign matter adhesion nozzle.

Therefore, the control unit 6 executes the operation of, after trapping air bubbles in at least one of the liquid inside the foreign matter adhesion nozzle 110 which is the nozzle 110 with foreign matter adhered or the liquid inside the pressure chamber 141 in communication with the foreign matter adhesion nozzle 110, which can be a cause of discharge abnormalities, having the testing unit test for discharge abnormalities of the nozzle 110. By trapping air bubbles, the vibration pattern of the residual vibration of the foreign matter adhesion nozzle changes. Because of this, it is possible to test for discharge abnormalities of the nozzle 110 in a state with a broadened difference between the vibration pattern of the residual vibration of a normal nozzle 110 and the vibration pattern of the residual vibration of an abnormal nozzle 110.

Also, the operation for detecting discharge abnormalities due to adhesion of foreign matter on the nozzle surface can also be said to be an operation of performing testing using the testing unit after breaking the meniscus of the liquid on the foreign matter adhesion nozzle.

Therefore, the control unit 6 executes the operation of having the testing unit test for discharge abnormalities after the meniscus of the liquid is broken on the foreign matter adhesion nozzle which is the nozzle 110 with foreign matter adhered. By breaking the meniscus, air bubbles are trapped inside the foreign matter adhesion nozzle, or inside the pressure chamber in communication with the foreign matter adhesion nozzle, and the vibration pattern of the residual vibration of the foreign matter adhesion nozzle changes. Because of this it is possible to test for discharge abnormalities of the nozzle 110 in a state with a broadened difference between the vibration pattern of the residual vibration of a normal nozzle 110 and the vibration pattern of the residual vibration of an abnormal nozzle 110.

Above, we gave specific descriptions about embodiments of the invention created by the inventors, but the present invention is not limited to the embodiments noted above and their modification examples, and it is possible to add various changes within a scope that does not stray from its gist.

For example, with the embodiment noted above, a detailed description was given regarding an embodiment of the present invention with a so-called multi-pass inkjet printer 1 as the subject, but the present invention can be applied to all types of inkjet printers (liquid discharge device) including a line head type printer as the subject.

Also, with the embodiment noted above, we described an example of executing the flushing process as an operation of wetting the nozzle surface before the residual vibration detection process, but the invention is not limited to this, and it is sufficient as long as the nozzle surface is wetted using a liquid such as ink or the like. For example, it is possible to use various methods other than flushing, such as showering, dipping, stamping and the like.

Also, with the embodiment noted above, with the operation of wetting the nozzle surface (flushing process), for the liquid for wetting the nozzle surface, the same ink as the ink used for image formation was used, but the invention is not limited to this. As the liquid used for the nozzle surface wetting operation such as flushing or the like, it is also possible to use a different liquid. By using a different liquid to wet the nozzle surface, it is possible to save the liquid used for image formation or the like. As a different liquid, for example it is possible to use only an ink solvent, or to use a solvent with a high affinity with ink other than an ink solvent. It is also possible to use water or a cleaning solution. Also, when using a different liquid, it is also possible to newly provide a nozzle surface wetting part separate from the nozzle 110, and to wet the nozzle surface by discharging a different liquid from the nozzle surface wetting unit.

General Interpretation Of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge device comprising:

a head having a piezoelectric element configured and arranged to vibrate a vibrating plate, a pressure chamber configured and arranged to increase and decrease an internal pressure by vibrating the vibrating plate, and a nozzle in communication with the pressure chamber, configured and arranged to discharge liquid housed in the pressure chamber by increasing and decreasing the internal pressure of the pressure chamber;

a drive unit configured and arranged to output drive signals to the piezoelectric element;

a testing unit configured and arranged to test for discharge abnormality of the nozzle based on a vibration pattern of residual vibration within the pressure chamber that occurred due to the drive signals; and a control unit configured to control the drive unit to output a second drive signal after a first drive signal is output, and to control the testing unit to test the discharge abnormality of the nozzle after the second drive signal is output by the drive unit.

2. The liquid discharge device according to claim 1, wherein the first drive signal is a drive signal for exhausting the liquid from the nozzle.

3. The liquid discharge device according to claim 1, wherein the second drive signal has a waveform that is different from a waveform of the first drive signal, and the second drive signal is a resonance waveform drive signal that resonates with natural vibration of the pressure chamber.

4. The liquid discharge device according to claim 3, wherein the resonance waveform has N times of vibration, with N being an integer of 2 or greater.

5. The liquid discharge device according to claim 4, wherein with the resonance waveform, an amplitude of an Nth vibration is greater than an amplitude of a first vibration.

6. The liquid discharge device according to claim 1, wherein the first drive signal has a waveform that is the same as a waveform of the second drive signal, and the first drive signal and the second drive signal are resonance waveform drive signals that resonate with natural vibration of the pressure chamber.

7. A discharge abnormality testing method for a head having a piezoelectric element configured and arranged to vibrate a vibrating plate, a pressure chamber configured and arranged to increase and decrease an internal pressure by vibrating the vibrating plate, and a nozzle in communication with the pressure chamber and configured and arranged to discharge liquid housed in the pressure chamber by increasing and decreasing the internal pressure of the pressure chamber, the discharge abnormality testing method comprising:

outputting a second drive signal to the piezoelectric element after a first drive signal is output; and testing discharge abnormality of the nozzle based on a vibration pattern of residual vibration within the pressure chamber that occurred due to the second drive signal.

* * * * *